US009134695B2

(12) United States Patent
Furukawa et al.

(10) Patent No.: US 9,134,695 B2
(45) Date of Patent: Sep. 15, 2015

(54) IMAGE FORMING APPARATUS WITH MOVABLE CARTRIDGE PRESSING MEMBER

(71) Applicant: CANON KABUSHIKI KAISHA, Tokyo (JP)

(72) Inventors: Tetsuo Furukawa, Yokohama (JP); Kenji Watanabe, Suntou-gun (JP); Toshiharu Kawai, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/016,491

(22) Filed: Sep. 3, 2013

(65) Prior Publication Data

US 2014/0064782 A1 Mar. 6, 2014

(30) Foreign Application Priority Data

Sep. 5, 2012 (JP) ..... 2012-195024
Aug. 7, 2013 (JP) ..... 2013-163751

(51) Int. Cl.
*G03G 21/18* (2006.01)
*G03G 21/16* (2006.01)

(52) U.S. Cl.
CPC ..... *G03G 21/1853* (2013.01); *G03G 21/1633* (2013.01); *G03G 21/1828* (2013.01)

(58) Field of Classification Search
CPC ..... G03G 21/1842; G03G 21/1828; G03G 21/1853
USPC ..... 399/110, 112, 126, 90, 107, 111
See application file for complete search history.

(56) References Cited

U.S. PATENT DOCUMENTS

| | | | | |
|---|---|---|---|---|
| 7,463,847 | B2 | 12/2008 | Sato | |
| 7,486,907 | B2 | 2/2009 | Noguchi et al. | |
| 7,664,428 | B2 * | 2/2010 | Kei | 399/110 |
| 7,761,024 | B2 | 7/2010 | Imaizumi et al. | |
| 7,907,866 | B2 | 3/2011 | Imaizumi et al. | |
| 8,175,487 | B2 | 5/2012 | Imaizumi et al. | |
| 8,238,789 | B2 | 8/2012 | Seorl et al. | |
| 8,442,412 | B2 | 5/2013 | Imaizumi et al. | |
| 2010/0239314 | A1 * | 9/2010 | Takayama | 399/112 |
| 2011/0116833 | A1 * | 5/2011 | Maeda et al. | 399/112 |
| 2011/0293324 | A1 * | 12/2011 | Hoashi | 399/112 |
| 2013/0108316 | A1 | 5/2013 | Sato et al. | |

FOREIGN PATENT DOCUMENTS

JP 2007-213018 A 8/2007

* cited by examiner

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

An image forming apparatus for forming an image on a recording material includes a detachably mountable cartridge and a pressing member movable between a pressing position for applying a pressing force to the cartridge to fix the cartridge to an image forming position and a non-pressing position. In addition, a limiting member moves between a limiting position and a non-limiting position. In the limiting position, the limiting member is close to the cartridge placed in the image forming position, with a gap therebetween to limit movement of the cartridge if the cartridge moves against the pressing force of the pressing member. The limiting member permits the cartridge to move from the image forming position to a retracted position, by moving from the limiting position to the non-limiting position.

17 Claims, 23 Drawing Sheets

(a)

(b)

(a)

(b)

(a)

(b)

IMAGE FORMING APPARATUS WITH MOVABLE CARTRIDGE PRESSING MEMBER

FIELD OF THE INVENTION AND RELATED ART

The present invention relates to an image forming apparatus which forms an image on recording medium.

Here, an image forming apparatus means an apparatus which forms an image on recording medium with the use of one of various known image formation principles/methods such as an electrophotographic process, an electrostatic recording process, a magnetic recording process, etc. For example, it includes a copying machine, a printer (for example, laser printer, LED printer, etc.), a facsimile machine, an image displaying apparatus, etc. Recording medium includes means on which an image is formed by an image forming apparatus. It includes a sheet of paper, an OHT sheet, etc.

A cartridge means a cartridge in which an image bearing component on which an image is formed, and a part or entirety of an image formation section having image formation process means which acts on the image bearing means, are integrally placed. It contributes to an image formation process for forming an image on recording medium, by being removably installed in the main assembly of an image forming apparatus. Hereafter, an image forming apparatus main assembly (which hereafter may be referred to simply as apparatus main assembly) means an image forming apparatus of the cartridge type, minus the cartridges.

As an image forming component, a component such as an electrophotographic photosensitive component used in an electrophotographic process, a dielectric component used in an electrostatic recording process, a magnetic component used in a magnetic recording process, and also, various components on which an image can be formed with the use of one of various image formation principles/methods, can be used. An image formation process means includes an image formation process device which forms an image by processing image bearing component.

Hereinafter, for the sake of convenience, the present invention is described with reference to an electrophotographic image forming apparatus of the cartridge type. As a cartridge, a process cartridge and a development cartridge can be listed, for example.

A process cartridge means a cartridge in which one or more among charging means, developing means, and cleaning means, which are electrophotographic processing means, and an electrophotographic photosensitive component which is an image bearing component, are integrally disposed, and which is removably installable in the apparatus main assembly. That is, a process cartridge includes a cartridge in which developing means as processing means, and an electrophotographic photosensitive component, are integrally disposed, and which is removably installable in the main assembly of an electrophotographic image forming apparatus.

Further, a process cartridge includes a cartridge in which charging means, developing means or cleaning means, which are processing means, and an electrophotographic photosensitive component, are integrally disposed, and which can be removably installable in the apparatus main assembly.

A process cartridge in which an electrophotographic photosensitive component and developing means are integrally held is referred to as a process cartridge of the so-called integration type, whereas a process cartridge in which an electrophotographic photosensitive component, and processing means other than developing means, are integrally disposed, is referred to as a process cartridge of the so-called separation type. That is, a process cartridge which is used in combination with a development unit in which developing means is disposed, for forming an image, is referred to as a process cartridge of the so-called separation type.

A process cartridge can be installed into, or removed from, the apparatus main assembly, by a user himself or herself. Therefore, a process cartridge makes it easier for a user to maintain the apparatus main assembly.

A development cartridge means a cartridge which has a development roller, stores powdery developer (toner) used for the development of an electrostatic latent image formed on an electrophotographic photosensitive component with the use of the development roller, and is removably installable in the apparatus main assembly.

In the case of an electrophotographic image forming apparatus which employs a development cartridge, its electrophotographic photosensitive component is attached to the apparatus main assembly, or a cartridge supporting component, or it is disposed in the above described process cartridge of the so-called separation type (in this case, process cartridge does not have developing means). A development cartridge also can be removably installable in the apparatus main assembly by a user. Therefore, a development cartridge can makes it easier for the user to maintain the apparatus main assembly.

In other words, a cartridge includes the above described process cartridge of the so-called integration type, and also, the above described process cartridge of the so-called separation type. Further, it includes the development cartridge used in combination with the process cartridge of the so-called separation type, and a development cartridge removably installable in the main assembly of an electrophotographic image forming apparatus, the electrophotographic photosensitive component of which is attached to the apparatus main assembly or cartridge supporting component, in such a manner that it can process the electrophotographic photosensitive component.

There is disclosed in Japanese Laid-open Patent Application 2007-213018, an image forming apparatus which uses replaceable process cartridges, and is structured so that multiple process cartridges can be installed into, or uninstalled from, the apparatus main assembly, by being mounted in the cartridge moving component of the apparatus. There is also disclosed in the same patent application, a structural arrangement for an image forming apparatus, which keeps a process cartridge properly positioned for image formation, by pressing the cartridge with the use of the resiliency of a spring or the like during an image forming operation, and causes the cartridge to be placed in contact with, or moved away from, the electrophotographic photosensitive component, by the opening or closing of the door (component which can be opened or closed) of the apparatus.

On the other hand, in order to reduce in size a shipment box for a combination of an image forming apparatus and process cartridges therefor so that it is easier for a user to handle the shipment box, it has been a common practice to install process cartridges in the apparatus main assembly before the combination is placed in the shipment box, and place the apparatus in a shipment box made of corrugated board, styrol foam or the like.

However, it is difficult to keep the process cartridges in their preset positions in the main assembly of an image forming apparatus, with the use of the above described prior art. That is, the above-described pressing force is insufficient to prevent the cartridges in the main assembly of an image forming apparatus from shifting due to the impacts and/vibrations which occur while the apparatus is transported. The above described cartridge pressing force is sufficient to keep the cartridges in the normal positions (image formation positions) against the force to which the cartridges are subjected by the cartridge driving force, electrical contacts, etc., during an image forming operation. However, the amount of the impact to which the cartridges are subjected during the above described transportation of the image forming apparatus reaches several times 10 G-100 G. Therefore, it is impossible for the above-described cartridge pressing force to prevent the cartridges positioned in the apparatus main assembly before the image forming apparatus is shipped out in the shipment box, from shifting from their normal positions.

If the pressing force is increased enough for the cartridges to be properly held, the force necessary to operate a door or the like to install or remove the cartridges increases, which in turn reduces usability.

As described above, the cartridges placed in the apparatus main assembly of an image forming apparatus are likely to shift due to the impacts and vibrations which occur during the transportation of the apparatus. Therefore, the cartridge is likely to displace from their normal positions and/or become damaged, and/or the cartridge pressing mechanism is likely to be damaged, during the transportation of the apparatus. In the case of the prior art, therefore, the cartridges and/or apparatus main assembly is fitted with packing or the like to prevent the cartridges from shifting. However, the packing or the like has to be removed by a user before the image forming apparatus is used.

SUMMARY OF THE INVENTION

Thus, the primary object of the present invention is to prevent the cartridges in their image formation positions in an image forming apparatus from shifting during the transportation of the image forming apparatus, without reducing usability, in order to protect the cartridges and image forming apparatus during the transportation of the apparatus.

According to an aspect of the present invention, there is provided an image forming apparatus for forming an image on a recording material, wherein a cartridge is detachably mountable, said image forming apparatus comprising an opening through which said cartridge is passed when said cartridge is mounted to and demounted from a main assembly of said apparatus; an openable member movable between a close position for closing said opening and an open position for opening said opening; a pressing member movable between a pressing position for applying a pressing force to said cartridge to fix said cartridge to an image forming position inside said main assembly, and a non-pressing position in which said cartridge is not pressed by said pressing member; an interrelating member for interrelations such that (i) with the movement of said openable member from the close position to the open position, said pressing member is moved from the pressing position to the non-pressing position, and said cartridge is moved from the image forming position to a retracted position, and (ii) with the movement of said openable member from the open position to the close position, said cartridge is moved from the retracted position to the image forming position, and said pressing member is moved from the non-pressing position to the pressing position; and a limiting member movable between a limiting position for preventing said cartridge positioned in the image forming position from moving against the pressing force of said pressing member, and a non-limiting position for permitting said cartridge to move from the image forming position to the retracted position.

Further features of the present invention will become apparent from the following description of exemplary embodiments (with reference to the attached drawings).

DESCRIPTION OF THE PREFERRED EMBODIMENTS

Embodiment 1

General Structure of Example of Image Forming Apparatus

Figure 1:
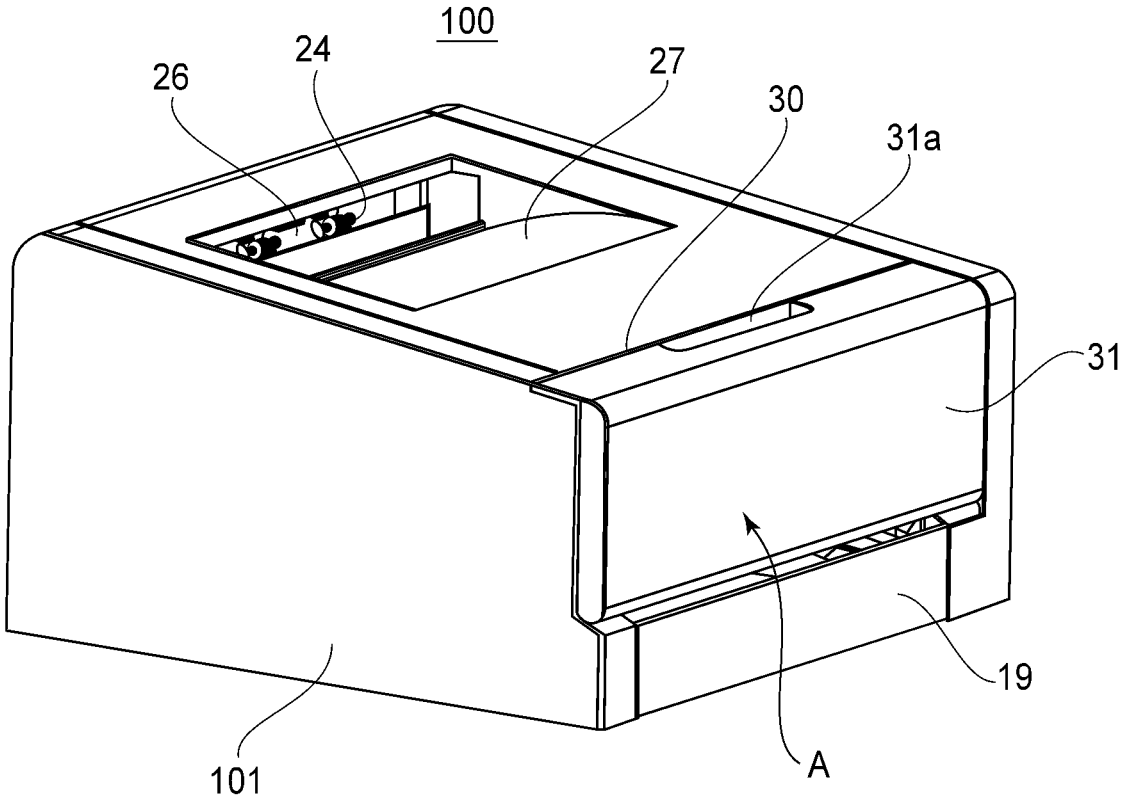
FIG. 1 is an external perspective view of the image forming apparatus in the first embodiment of the present invention.
Figure 2:
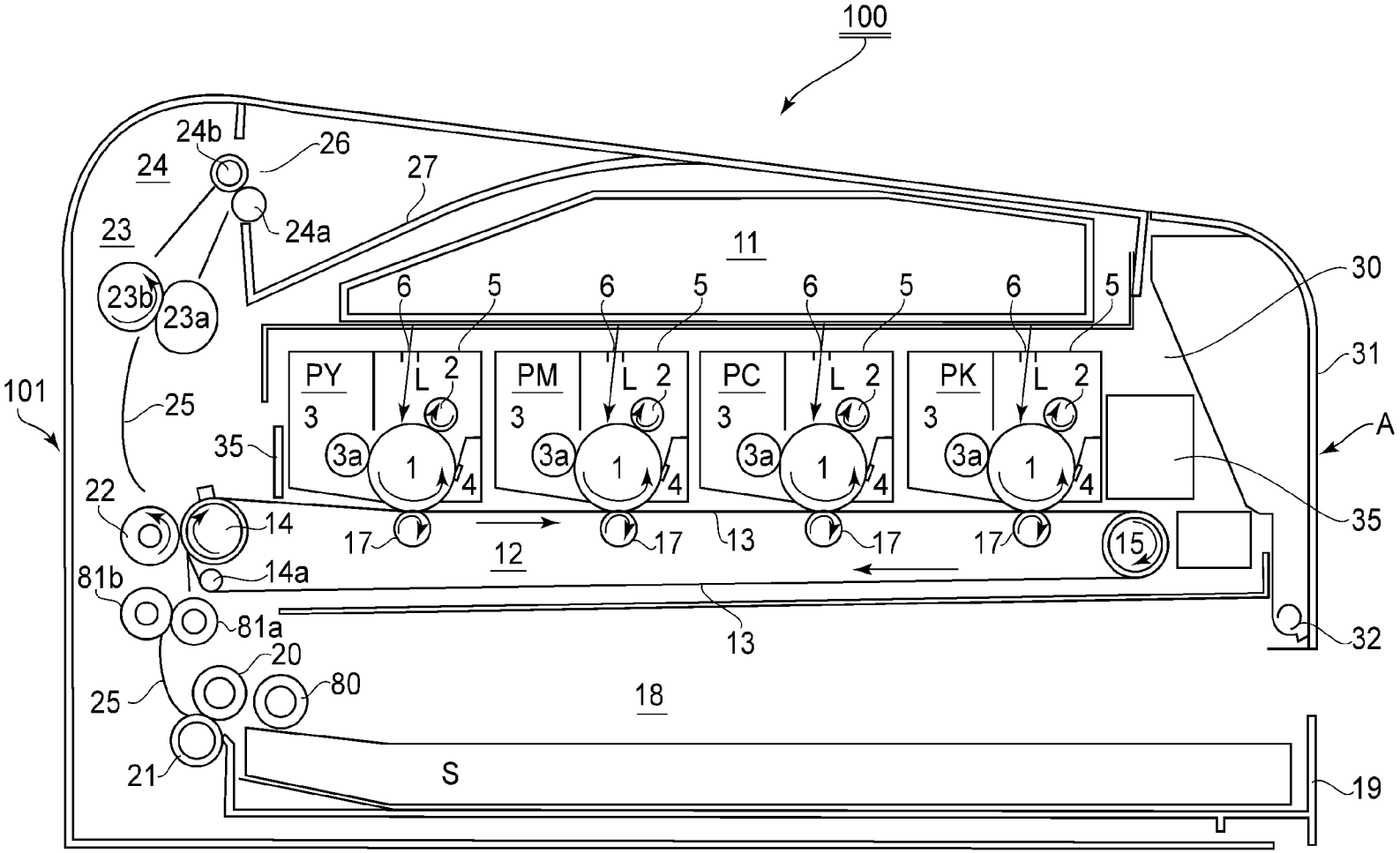
FIG. 2 is a sectional view of the image forming apparatus at a plane parallel to the front surface of the apparatus, as seen from the front side of the apparatus.

FIG. 1 is an external perspective view of the image forming apparatus 100 in the first embodiment of the present invention. FIG. 2 is a sectional view of the apparatus at a plane parallel to the front surface of the apparatus, as seen from the right side of the apparatus. First, referring to FIGS. 1 and 2, the general structure of the image forming apparatus 100 in this embodiment is described. The image forming apparatus 100 in this embodiment uses an electrophotographic process. It is a full-color laser printer based on four primary colors. Further, it is of the cartridge type. It forms an image on a sheet S of paper (recording medium), in response to electrical image formation signals inputted into the control section of the apparatus from an external host apparatus (unshown) such as a personal computer, an image reader, a facsimile machine (on transmitting side), etc.

In the following description of the embodiments of the present invention, regarding the directions of the image forming apparatus 100, or image forming apparatus main assembly 101 (image forming apparatus minus cartridges, which will be referred to simply as apparatus main assembly), the front side (front surface side) means the side where the door (opening/closing component) 31 is present. The rear side is the opposite side from the front side. The frontward/rearward direction means both the front-to-rear direction and the rear-to-front direction. The left and right means the left and right as seen from the front side. The left/right direction means both the leftward and rightward directions. The upward/downward means the upward/downward in terms of the direction parallel to the gravity direction.

In the apparatus main assembly 101, four process cartridges, more specifically, the first to fourth process cartridges (which will be referred to simply as cartridge) P (PY, PM, PC and PK) are roughly horizontally aligned in parallel (inline structure, tandem type) in the rear-to-front direction.

A cartridge P is a cartridge in which a part or entirety of the image forming section which has an image bearing component, on which an image is formed, and image formation process means which processes the image bearing component, are integrally disposed. It is removably installed in the main assembly of the image forming apparatus to be made to contribute to the image formation process for forming an image on recording medium.

In this embodiment, each cartridge P is of the integration type. The four cartridges P are different only in the color of the toner (developer) they store in their developing device. In terms of the electrophotographic image process system (image formation section) they have, they are the same. That is, each cartridge P has: an electrophotographic photosensitive drum (which will be referred to simply as drum) 1 as the image bearing component (first image bearing component). It has also a charging device 2 as image formation process means which processes the drum 1; a developing device 3; and a cleaning device 4. The abovementioned drum 1, charging device 2, and cleaning device 4 are integrally attached to the inward side of the cartridge frame 5.

The charging device (charging means) 2 is a charge roller, which contacts the drum 1. The developing device (developing means) 3 has a development roller 3*a*, and stores developer (toner) in its developer container. The cleaning device (cleaning means) 4 is of the blade type; it has a blade which contacts the drum 1. The lengthwise direction is the direction parallel to the rotational axis of the drum 1. The portion of the apparatus main assembly 101, which is for allowing each cartridge P to be installed into, or removed from, the apparatus main assembly 101, will be described later.

When each cartridge P is in its preset image formation position (normal position) in the apparatus main assembly 101, it remains immovably held in the image formation position by a preset cartridge positioning section, which will be described later. Further, the driving force input section (unshown) of each cartridge P is in engagement with the driving force output section of the apparatus main assembly 101, enabling thereby the driving force to be inputted into each cartridge P from the apparatus main assembly 101.

Further, the electrical contacts (unshown) of each cartridge P are in connection to the electrical power supply system (unshown) of the apparatus main assembly 101, making it possible for bias voltages (charge bias, development bias, etc.,) to be inputted into each cartridge P from the apparatus main assembly 101.

The first cartridge PY stores toner of yellow (Y) color, in its developing device 3. It forms a toner image of yellow (Y) color on the peripheral surface of the drum 1. The second cartridge PM stores toner of magenta (M) color in its developing device 3. It forms a toner image of the M color on its drum 1. The third cartridge PC stores toner of cyan (C) color in its developing device 3. It forms a toner image of the C color. The fourth cartridge PK stores toner of black (K) color in its developing device 3. It forms toner image of the K color on the peripheral surface of its drum 1.

There is disposed a laser scanner unit 11 as drum exposing means, above the combination of the first to fourth cartridges PY, PM, PC and PK. This scanner unit 11 scans (exposes) the peripheral surface of the drum 1 of each cartridge P, through an exposure window 6 with which the top wall of the cartridge frame 5 is provided, by outputting a beam L of laser light while modulating the beam L according to the information of each of the four monochromatic images, different in color, outputted from the external host (unshown).

There is disposed an intermediary transfer belt unit 12 below the combination of the first to fourth cartridges PY, PM, PC and PK. This belt unit 12 has: an endless belt 13, which is a flexible image transferring component made of a dielectric substance; and a combination of a driver roller 14 which circularly moves the endless belt 13, a tension roller 15, and an auxiliary roller 14*a*, by which the endless belt 13 is suspended and kept tensioned. The driver roller 14 and auxiliary roller 14*a* are disposed in the rear portion of the apparatus main assembly 101 (first cartridge PY side). The tension roller 15 is disposed in the front portion (fourth cartridge PK side) of the apparatus main assembly 101.

Each cartridge P is in contact with the top surface of the belt 13, that is, the outward surface of the top portion of the belt 13, in terms of the loop which the belt 13 forms. There are disposed four primary transfer rollers 17, in the inward side of the belt loop, in such a manner that they oppose the drums 1 in the four cartridges P, one for one. The area of contact (nip) between the drum 1 of each cartridge P, and the belt 11, is the primary transfer station. There are disposed the second transfer roller 22 in such a manner that it is pressed against the driver roller 14 with the presence of the belt 13 between itself and the driver roller 14. The area of contact (nip) between the secondary transfer roller 22 and belt 13 is the secondary transfer station.

There is disposed a sheet feeding/conveying unit 18 below the belt unit 12. This sheet feeding/conveying unit 18 has: a sheet feeder tray 19, in which multiple sheets S of paper, as recording medium, are stored in layers; a sheet feeder roller 80; a sheet conveyance roller 20; a separation roller 21, etc. The sheet feeder tray 19 can be pulled out of, or put back into, the apparatus main assembly 101, from the front side of the apparatus main assembly 101 (front loading).

There is disposed in the rear section of the apparatus main assembly 101, a sheet conveyance upward passage 25, which extends from the sheet conveying bottom roller 20 to the sheet discharge outlet 26, which is at the top of the apparatus main assembly 101. Further, there are disposed a pair of registration rollers (conveyance rollers) 81*a* and 81*b*, the secondary transfer roller 22, a fixing device 23, and a pair of sheet discharge rollers 24, along this sheet conveyance passage 25, listing from the bottom side. A part of the top surface of the apparatus main assembly 101 is used as a delivery tray 27. The fixing device 23 used in this embodiment has a fixation film assembly 23*a* and a pressure roller 23*b*. The pair of discharge rollers 24 are the sheet discharge rollers 24*a* and 24*b*.

(Image Forming Operation)

The operation for forming a full-color image is as follows: The drum 1 in each of the first-fourth cartridges PY, PM, PC and PK is rotationally driven in the counterclockwise direction indicated by an arrow mark at a preset control speed. The belt 13 is circularly driven in the clockwise direction indicated by an arrow mark in FIG. 2, at a preset speed, which corresponds to the speed of the drum 1.

The scanner unit 11 also is driven. In synchronism with this driving of the scanner unit 11, the charge roller 2 in each cartridge P uniformly charges the peripheral surface of the drum 1 to preset polarity and potential level with a reset control timing. The charge roller 2 is rotated by the rotation of the drum 1. The scanner unit 11 scans (exposes) the peripheral surface of the drum 1 with the beam L of laser light it outputs while modulating the beam L with the image formation signals which correspond one for one to the monochromatic toner images, different in color, into which the original has been separated. Consequently, an electrostatic latent image, which reflects the image formation signals of the corresponding color is formed on the peripheral surface of the drum 1. The formed electrostatic latent image is developed as a toner image by the developing device 3.

Through the electrophotographic image formation process, a toner image of the Y color, which corresponds to the Y color component of the full-color image is formed on the drum 1 of the first cartridge PY. Then, the toner image is transferred (primary transfer) onto the belt 13.

On the peripheral surface of the drum 1 of the second cartridge PM, a toner image of the M color, which corresponds to the M color component of the full-color image is formed. Then, the toner image of the M color is transferred (primary transfer) onto the belt 13 in such a manner that it is laid upon the toner image of the Y color, which has just been transferred (primary transfer) onto the belt 13.

On the peripheral surface of the drum 1 of the third cartridge PC, a toner image of the C color, which corresponds to the C color component of the full-color image is formed. Then, the toner image is transferred (primary transfer) onto the belt 13 in such a manner that it is laid upon the combination of the toner image of the Y color, and the toner image of the M color, which have just been transferred (primary transfer) onto the belt 13.

On the peripheral surface of the drum 1 of the fourth cartridge PK, a toner image of the K color, which corresponds to the K color component of the full-color image, is formed. The toner image is transferred (primary transfer) onto the belt 13 in such a manner that it is laid upon the combination of the Y, M and C color images, which have just been transferred (primary transfer) onto the belt 13.

Consequently, an unfixed full-color image is synthetically effected on the belt 13, by the toner images of the Y, M, C and K colors, respectively. In each cartridge P, the transfer residual toner, or the toner remaining on the peripheral surface of the drum 1 after the primary transfer of the toner image onto the belt 13, is removed by the cleaning device 4.

Meanwhile, the sheet feeder roller 80 begins to be driven with a preset control timing, whereby the one of the sheets S of paper as the recording medium stored in layers on the sheet feeder tray 19 is separated from the rest on the tray 19 by the separation roller 21, and is conveyed into the apparatus main assembly 101. Then, the sheet S is introduced into the nip (secondary transfer station) between the secondary transfer roller 22 and belt 13, by way of the pair of registration rollers 81*a* and 81*b*. Thus, the four toner images, different in color, layered on the belt 13 are transferred together onto the surface of the sheet S while the sheet S is conveyed, remaining pinched between the belt 13 and secondary transfer roller 22, as if they are peeled away from the belt 13.

Then, the sheet S is separated from the surface of the belt 13, and is introduced into the fixing device 23, in which it is subjected to heat and pressure in the fixation nip. Consequently, the four toner images, different in color, become fixed to the sheet S while being mixed. Then, the sheet S is moved out of the fixing device 23, and discharged as a full-color print by the pair of discharge rollers 24 onto the delivery tray 25 through the discharge opening 25.

In this embodiment, the secondary transfer residual toner, which is the toner remaining on the surface of the belt 13 after the separation of the sheet S, is electrostatically adhered to the peripheral surface of the drum 1 in the primary transfer station of the first cartridge PY, for example, and then, is removed by the cleaning device 4.

(Method for Replacing Cartridge)

Figure 4:
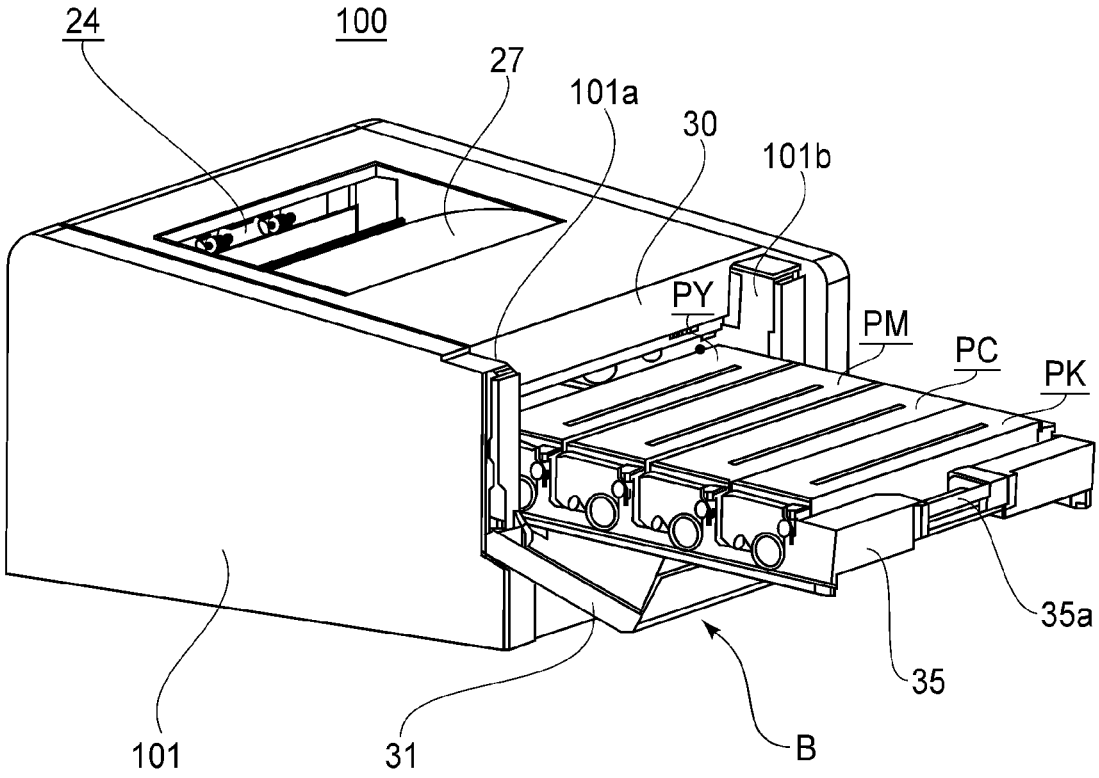
FIG. 4 is an external perspective view of the image forming apparatus when the cartridge tray of the apparatus is in its outside position which allows the cartridges P to be mounted into, or removed from, the cartridge tray.

The image forming apparatus 100 in this embodiment is of the so-called front access type. That is, the cartridges P are placed on the tray 35 which can be pulled out of the apparatus main assembly 101. Thus, when it is necessary to replace one or more of the cartridges P in the apparatus main assembly 101, the tray 35 can be pulled out of the apparatus main assembly 101 so that any or all of the cartridges P can be replaced. FIG. 4 shows the state of the image forming apparatus 100, in which the tray 35 has been pulled out of the apparatus main assembly 101, into the position in which the cartridges P can be placed in, or moved out of, the tray 35.

The front wall of the apparatus main assembly 101 is provided with an opening 30 through which the tray 35 can be moved in order to install the cartridges P into, or remove the cartridges P from, the apparatus main assembly 101. Further, the apparatus main assembly 101 is provided with a door (opening/closing component) 31, which can be pivotally moved between an open position A in which it keeps the opening 30 closed, and a closed position B in which it keeps the opening 30 exposed.

In this embodiment, the door 31 is pivotally movable relative to the apparatus main assembly 101, about the horizontal shaft (hinge shaft) 32, which is at the bottom edge of the door 31. That is, referring to FIGS. 1 and 2, the door 31 can be pivotally moved about the shaft 32 so that it will be in the position A, in which the door remains upright, keeping thereby the opening 30 closed. Next, referring to FIG. 3, the door 31 can also be pivotally moved frontward about the shaft 32 into the position B, in which the door 31 remains horizontal, leaving thereby the opening 30 fully exposed. A referential code 31*a* stands for a handhold with which the door 31 is provided.

Figure 5:
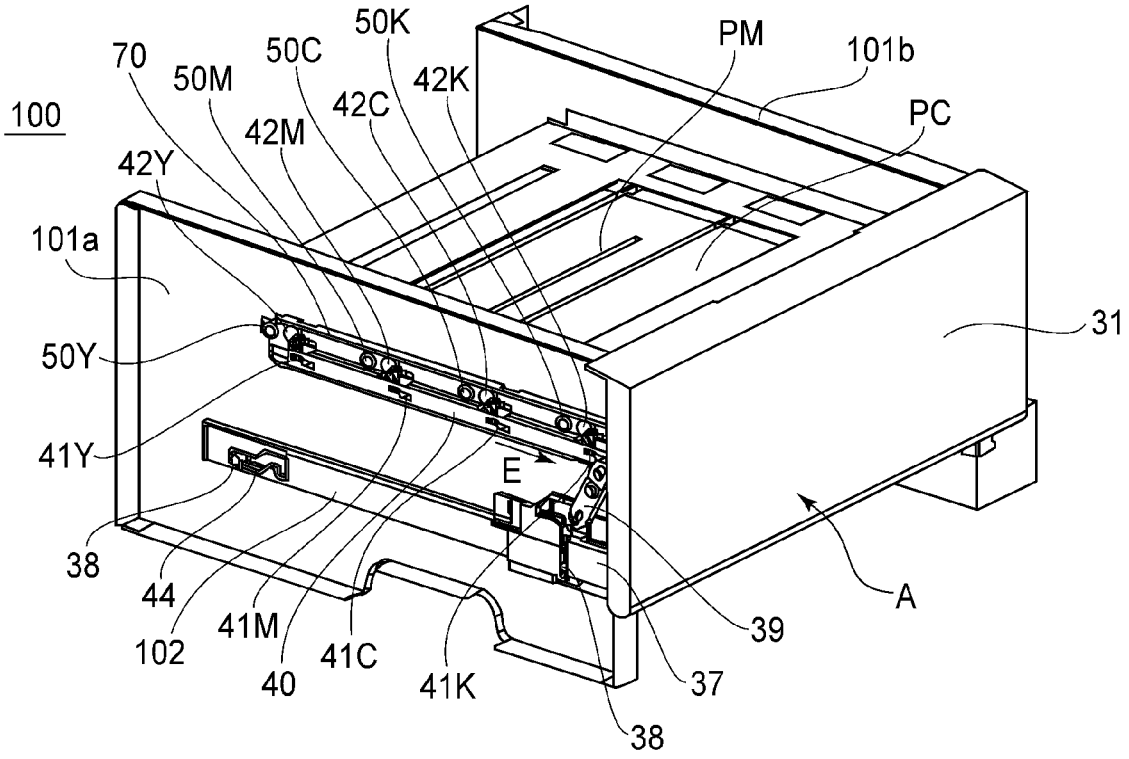
FIG. 5 is a perspective view of the image forming apparatus shown in FIG. 1, minus the external shell of the apparatus, showing the interior of the apparatus.
Figure 6:
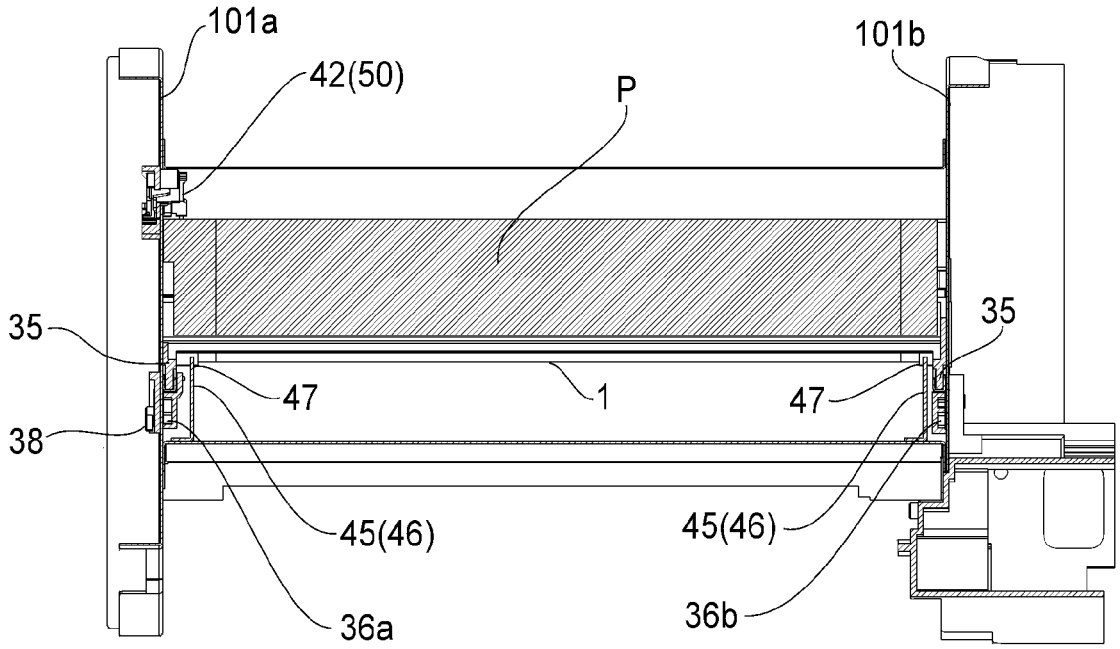
FIG. 6 is a sectional view of the apparatus shown in FIG. 5, at a plane parallel to the front surface of the apparatus, as seen from the front side.
Figure 7:
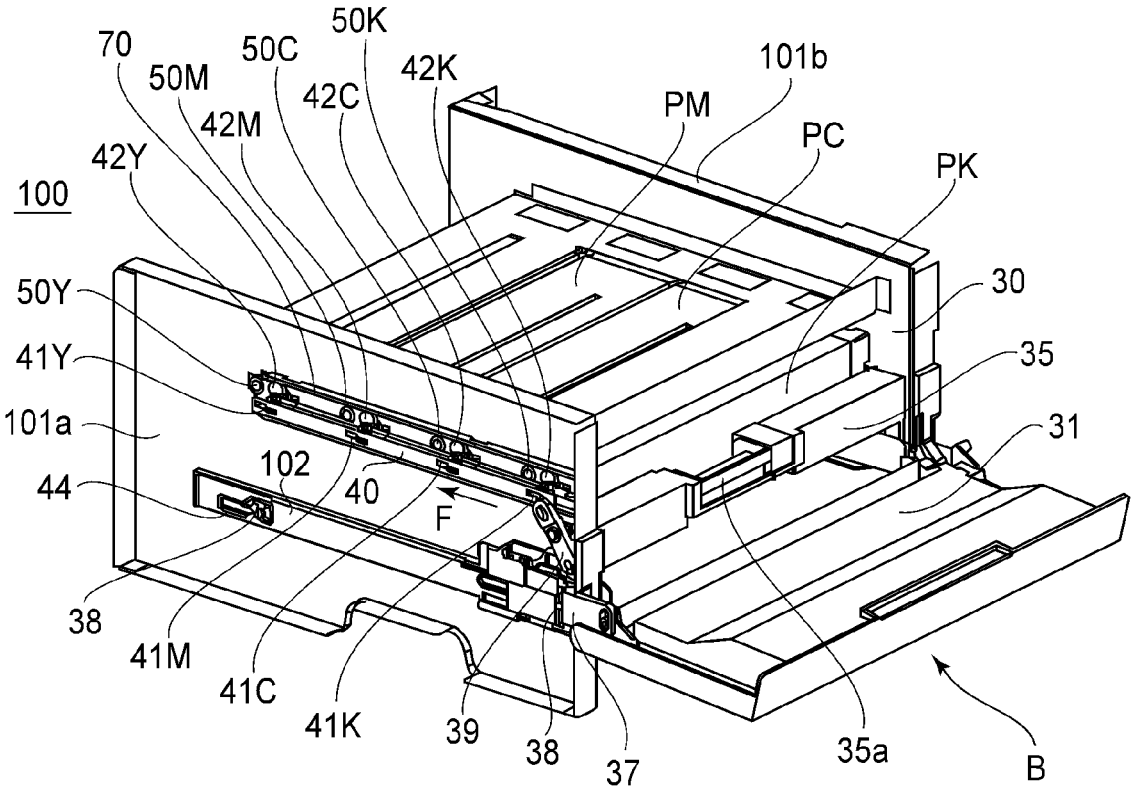
FIG. 7 is the same as FIG. 3, except that FIG. 7 does not show the external shell of the apparatus in order to show the interior of the apparatus.

FIG. 5 is a perspective view of the image forming apparatus 100, minus the external shell, and shows the interior of the apparatus 100. FIG. 6 is a sectional view of the image forming apparatus 100 which is in the state shown in FIG. 5, as seen from the front side of the apparatus 100. FIG. 7 is a perspective view of the image forming apparatus 100, minus its external shell, which is in the state shown in FIG. 3. It also shows the interior of the image forming apparatus 100.

Referring to FIGS. 5-7, referential codes 101*a* and 101*b* stand for the left and right plates of the main frame of the apparatus main assembly 101. Referring to FIG. 6, there are disposed a pair of tray rails 36*a* and 36*b* (left and right rails), on the inward surfaces of the left and right frame plates 101*a* and 101*b*, respectively, in such a manner that they extend in the frontward/rearward direction and oppose each other. The tray 35 is held by these left and right tray rails 36*a* and 36*b* in such a manner that the tray 35 can be horizontally slid in the frontward/rearward direction. The cartridges P are supported by the tray 35, being aligned in parallel in the frontward/rearward direction.

The left and right trail rails 36*a* and 36*b* are moved by the opening and closing movement of the door 31, in the manner which will be described next.

1) When Door 31 is Moved from Open Position B to Closed Position A

As the door 31 is moved from the open position B to the closed position A, a lever 37 linked to the door 31 is moved from the front side to the rear side (FIG. 7→FIG. 5). The apparatus main assembly 101 is provided with two levers 37, which are attached to the left and right frame plates 101*a* and 101*b*, one for one, being thereby symmetrically positioned in terms of the left/right direction. Thus, the left and right levers 37 are moved rearward from the front side, along the left and right tray rails 36*a* and 36*b*, by the bosses 38 which are integral parts of the left and right trail rails 36*a* and 36*b*, one for one. The bosses 38 of the left and right tray rails 36*a* and 36*b* are fitted in the guide grooves 44, with which left and right stationary components (right one is not shown) of the apparatus main assembly 101.

As the bosses 38 are moved rearward along the guide grooves 44 which correspond one for one to the bosses 38, the left and right tray rails 36*a* and 36*b* are diagonally moved by a preset amount. That is, they are moved rearward by the preset amount while being moved downward. With the left and right tray rails 36*a* and 36*b* moved as described above, the tray 35 also is moved downward by a preset amount in the apparatus main assembly 101 while remaining parallel to the left and right tray rails 36*a* and 36*b*. As the tray 35 is downwardly moved by the preset amount, it is stopped by the action of the stopper (unshown), being thereby fixed in position relative to the apparatus main assembly 101.

Each cartridge P is provided with cartridge positioning portions 47 (47Y, 47M, 47C and 47K, by which cartridge P is held properly positioned), which are specifically shaped for cartridge positioning. One of them is located at the intersection of the lengthwise bottom left edge and one of the widthwise bottom edges, whereas the other is located at the intersection of the lengthwise bottom right edge and the same widthwise bottom edge. Further, the cartridge positioning left and right plates 45 of the apparatus main assembly 101 are provided with cartridge positioning portions 46 (46Y, 46M, 46C and 46K), which correspond in position to the cartridge positioning portions (specifically shaped portions) 47 of the cartridge P.

Figure 8:
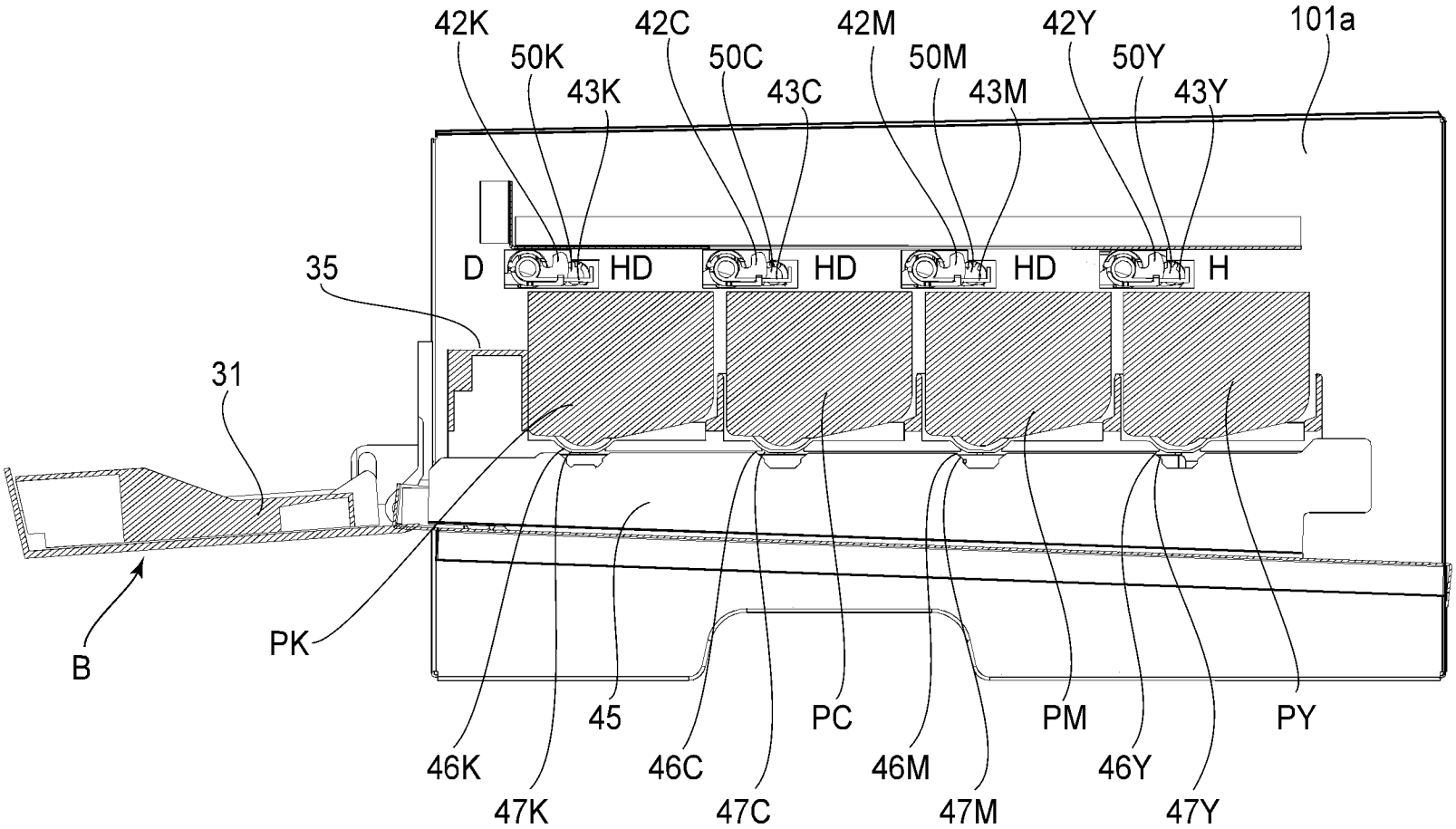
FIG. 8 is a sectional view of the image forming apparatus when the door is open. It shows the cartridge pressing mechanism.
Figure 9:
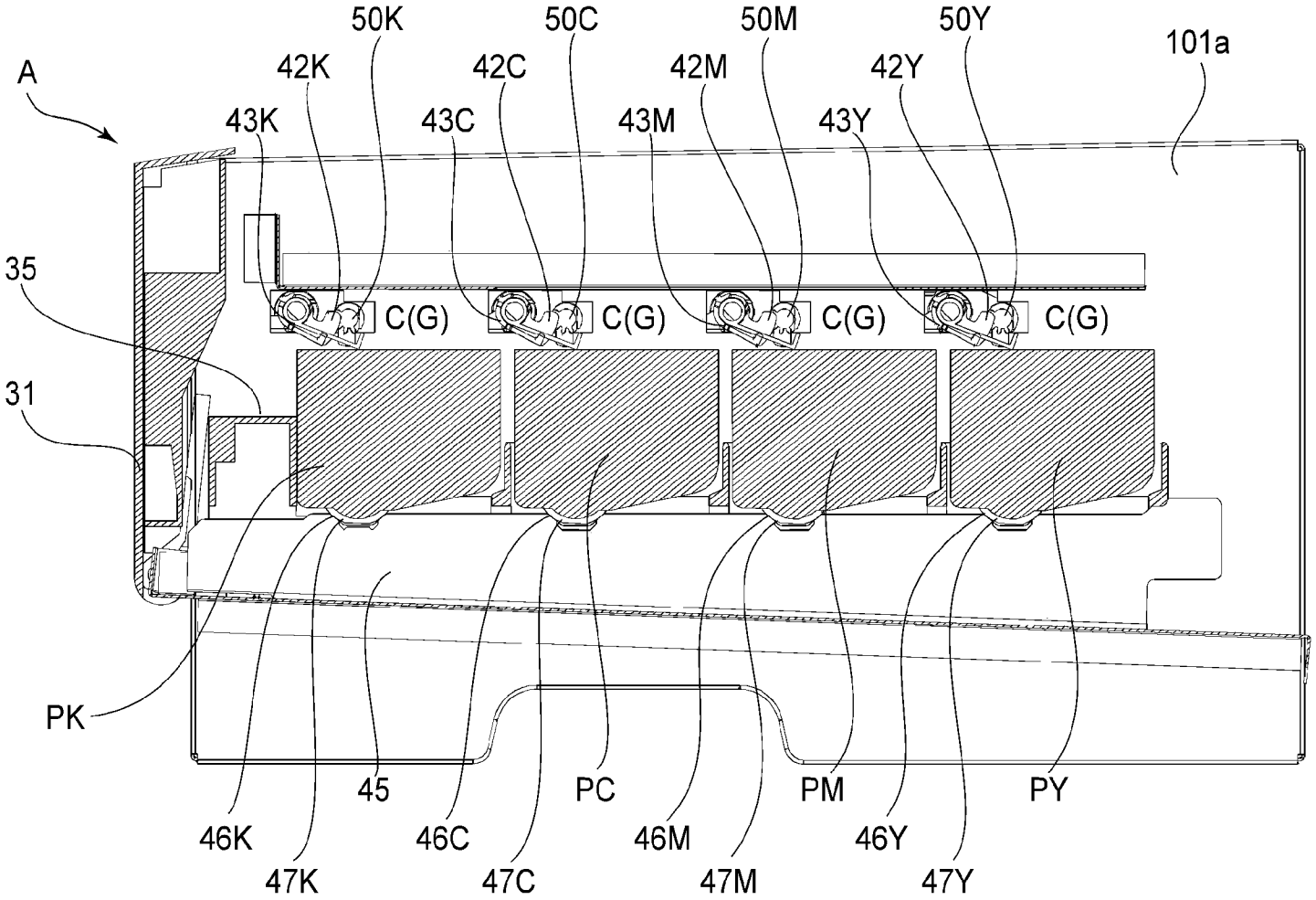
FIG. 9 is a sectional view of the image forming apparatus when the door is closed. It shows the cartridge pressing mechanism.

As the tray 35 moves downward, the cartridges P supported by the tray 35 also move downward. Consequently, the cartridge positioning portions 47 of each cartridge P engage with the cartridge positioning portions 46 of the apparatus main assembly 101 (FIG. 8→FIG. 9). That is, as the door 31 is moved from the open position B to the closed position A while the cartridges P are in the apparatus main assembly 101, the cartridges P are moved from their installation/removal positions (FIG. 8) in which they can be placed in, or removed from, the tray 35, to their image formation positions (FIG. 9).

As the cartridges P are moved into their image formation positions, spring cartridge holders 42 (42Y, 42M, 42C and 42K), as a cartridge pressing elastic components, with which the apparatus main assembly 101 is provided, and which correspond in position to the cartridges P one for one, are made to move. That is, each spring cartridge holder 42 is made to move from a no pressure position D (FIGS. 8 and 10) in which it does not apply pressure to the cartridge P, to a pressure application position C (FIGS. 9 and 11) in which it contacts the top surface of the cartridge P. As each spring cartridge holder 42 is moved to the pressure application position C, it applies a preset amount of pressure to the top surface of the corresponding cartridge P. Consequently, the cartridge positioning portion of each cartridge P is pressed upon the cartridge positioning portion 46 of the apparatus main assembly 101, causing thereby the cartridge P to be fixed in position relative to the apparatus main assembly 101.

That is, each cartridge P is moved into its image formation position in the apparatus main assembly 101, and is reliably kept in the image formation position. When the cartridges P are in their image formation positions, the downwardly facing portion of the peripheral surface of the drum 1 is in contact with the surface of the belt 13 in a preset manner. Further, the driving force outputting section (unshown) of the apparatus main assembly 101 is connected to the driving force input section (unshown) of each cartridge P disposed in its image formation position. Further, the power supply system (unshown) of the apparatus main assembly 101 is connected to the electric power input section of the cartridge P. It is when the image forming apparatus 100 is in the above-described state that the image forming apparatus 100 is capable of forming images.

2) When Door 31 is Moved from Closed Position A to Open Position B

As the door 31 is opened, the image forming apparatus 100 is made to follow in reverse the above-described steps, which occur as the door 31 is closed.

That is, during the initial stage of the opening of the door 31, the operation for disengaging the driving force output section of the apparatus main assembly 101 from the driving force input section of each cartridge P is carried out. Further, each spring cartridge holder 42 is moved from the positions C in which it applies pressure to the cartridge P, to the position D in which it does not apply pressure to the cartridge P; the operation for freeing the cartridge P from the pressure applied to thereto by the spring cartridge holder 42 is carried out. Moreover, the tray 31 is unlocked from the apparatus main assembly 101.

Then, as the door 31 is opened further, the bosses 38 of the left and right tray rails 36*a* and 36*b* are diagonally moved frontward by the preset amount by the pivotal movement of the door 31 in the opening direction. That is, the tray is moved frontward while being vertically moved upward. With the above described movement of the left and right tray rails 36*a* and 36*b*, the tray 35 also moves upward by a preset amount in parallel to the tray rails 36*a* and 36*b*. Therefore, each of the cartridges P held by the tray 35 is also moved upward.

Figure 3:
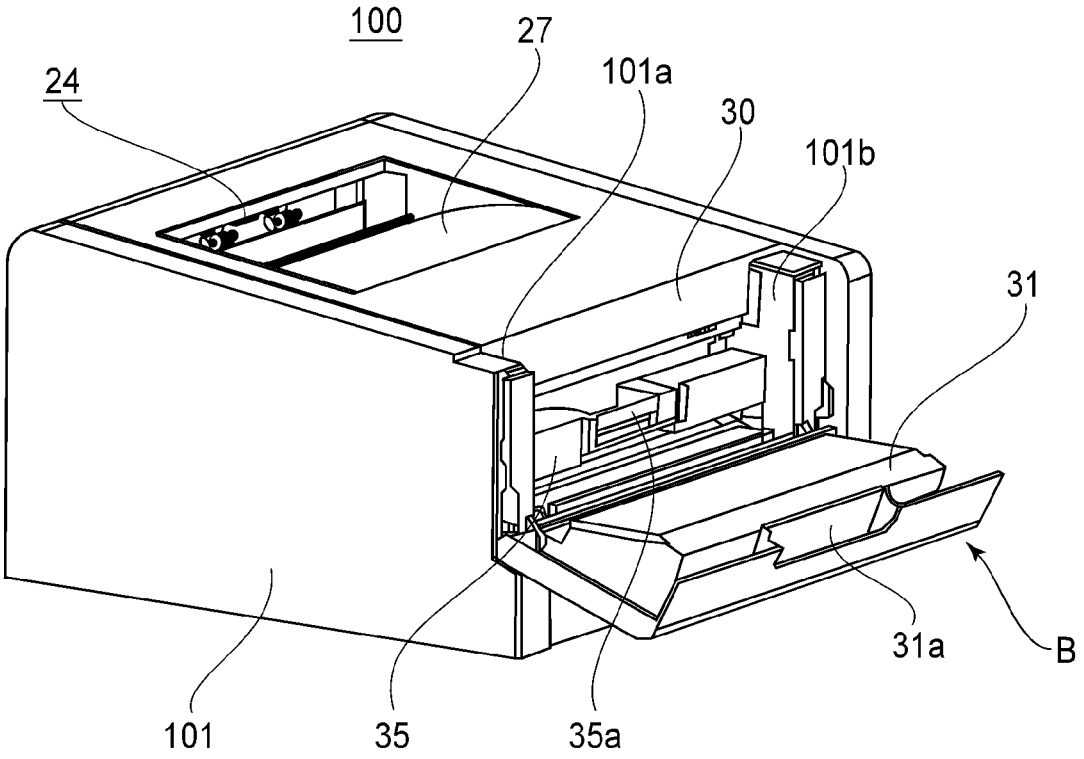
FIG. 3 is an external perspective view of the image forming apparatus when the door of the apparatus is open.

Consequently, the cartridge positioning portions 47 of each cartridge P move upward away from the cartridge positioning portions 46 of the apparatus main assembly 101 (FIG. 9→FIG. 8). That is, each cartridge P is moved from its image formation position (FIG. 9) to the no-image-formation position (FIG. 8). Further, the downwardly facing portion of the peripheral surface of the drum 1 in each cartridge P separates from the belt 13. Further, as the door 31 is fully opened to be placed into the open position B as shown in FIG. 3, the opening 30 is fully exposed, allowing thereby the tray 35 to be pulled out of the apparatus main assembly 101.

That is, as the door 31 is pivotally moved from the closed position A to the open position B when each cartridge P is in the apparatus main assembly 101, each cartridge P is moved from its image formation position to its no-image-formation position. Then, a user is to grasp the handhold 31*a* exposed through the opening 30 as shown in FIG. 3, and to horizontally slide the tray 31 frontward relative to the tray rails 36*a* and 36*b*.

The user is to pull out the tray 35 from the apparatus main assembly 101 through the opening 30, until it is moved into the preset cartridge installation/removal position (outermost tray position), as shown in FIG. 4. Consequently, the entire cartridges P held by the tray 35 are moved out of the apparatus main assembly 101 through the opening 30, being thereby fully exposed upward from the apparatus main assembly 101.

As the tray 35 is pulled out by a preset distance, that is, such a distance that is enough to expose the entire process cartridges P, it is stopped by the stopper (unshown), being thereby prevented from sliding out of the apparatus main assembly 101 by an unnecessary distance. Further, once the tray 35 is pulled out of the apparatus main assembly 101 and placed in the cartridge installation/removal position, it is horizontally and securely held in the position by the tray rails 36*a* and 36*b*. With the employment of this structural arrangement, the cartridges P can be replaced from the front side of the apparatus main assembly 101, without changing the belt 31 in position.

The tray 35 loosely supports each cartridge P so that the cartridge P can be easily removed upward from the tray 35, and also, so that the cartridge P can be supported by the tray 35 by being positioned above the tray 35, and then, moved straight downward. Thus, when it is necessary to replace a cartridge P (toner-depleted cartridge or the like) in the tray 35, the cartridge is to be extracted upward from the tray 35, and then, a new cartridge P (replacement cartridge) is to be fitted straight downward into the vacated cartridge space in the tray 35.

After the replacement of the old (depleted) cartridge with a fresh one, the tray 35, which is outside the apparatus main assembly 101, is to be horizontally slid rearward into the apparatus main assembly 101 along the tray rails 36*a* and 63*b*, through the opening 30, following in reverse the above described steps followed to pull the tray 35 out of the apparatus main assembly 101, until the tray 35 is stopped by the stopper (unshown) for preventing the tray 35 from being pushed farther into the apparatus main assembly 101.

Then, the door 31 is to be pivotally moved in the closing direction. As the door 31 is pivotally moved, the operation described in Section 1) is carried out, whereby each cartridge P is positioned in its image formation position in the apparatus main assembly 101. That is, the image forming apparatus 100 becomes ready for an image forming operation.

The tray 35 is a drawer which supports multiple (four in this embodiment) cartridges P. It is movable in the direction perpendicular to the lengthwise direction of the cartridge P, and is enabled to take the inward position in which it is within the apparatus main assembly 101, and the outward position into which it is put as it is pulled out of the apparatus main assembly 101 through the opening 30, and in which it allows the cartridges P to be installed into, or removed from, the tray 35.

Further, the linkage 37, bosses 38, tray rails 36*a* an 36*b*, stationary components 102 having the guide grooves 44, and tray 35 are the components which are moved by the opening or closing of the door 31 to move the cartridges P between their image formation positions and no-image-formation position, in the apparatus main assembly 101.

(Structure of Cartridge Pressing Means)

As described above, when the cartridges P are in the apparatus main assembly 101 while the door 31 is remaining closed, they remain under a preset amount of pressure generated by the spring cartridge holders (42Y, 42M, 42C and 42K) as cartridge pressing elastic components, remaining thereby fixed in their image formation positions.

Figure 10:
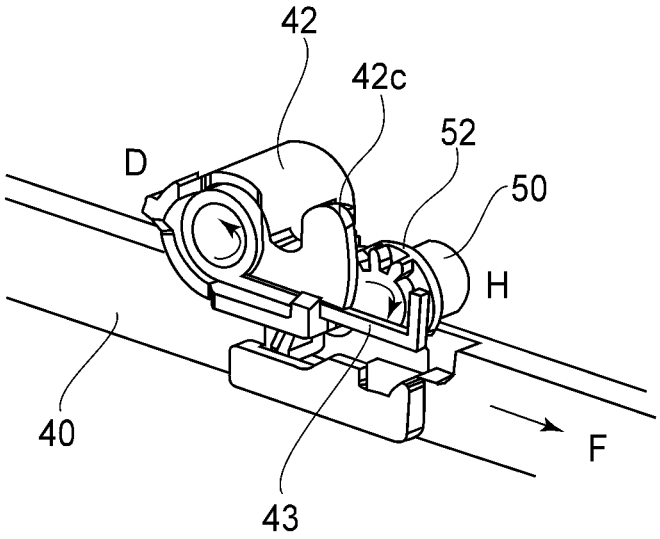
FIG. 10 is a perspective view of the cartridge pressing mechanism and its adjacencies when the door is open.
Figure 10:
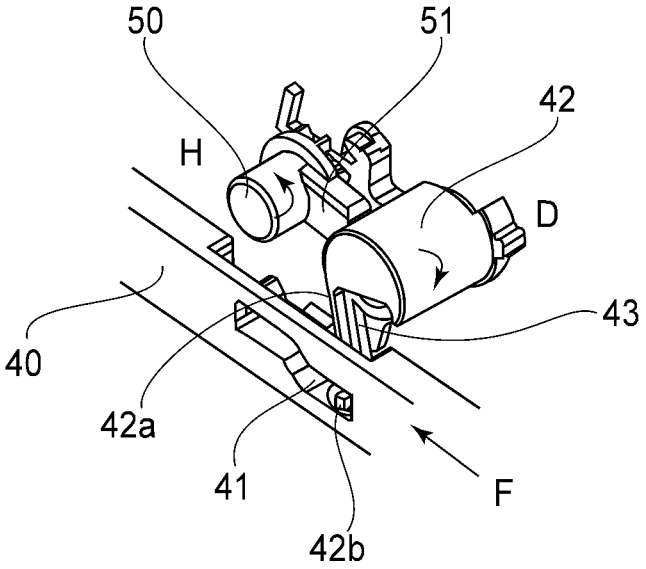
Figure 11:
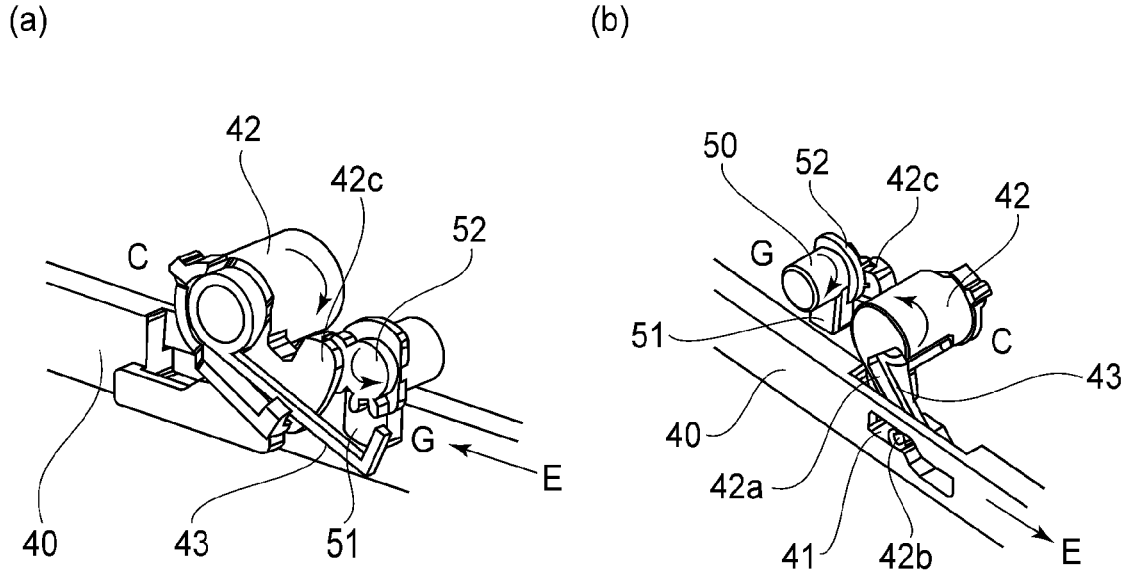
FIG. 11 is a perspective view of the cartridge pressing mechanism and its adjacencies when the door is closed.

Referring to FIGS. 5 and 7, the spring cartridge holders 42 which correspond one for one to the cartridges P are rotatably supported, with the presence of preset intervals, by a long guiding component 70, which is solidly attached to the left frame plate 101*b* in such an attitude that its lengthwise direction is parallel to the frontward/rearward direction. Each spring cartridge holder 42 is provided with an internal spring 43 (43Y, 43M, 43C and 43K) (FIGS. 10 and 11).

Next, referring to FIGS. 5 and 7, the cartridge pressing means is provided with a long rod 40, which is attached to the underside of the left frame plate 101*b*, in such a manner that its lengthwise direction is parallel to the frontward/rearward direction, and also, that it is slid in the frontward/rearward direction. The rod 40 is in indirect connection to the door 31, with the presence of a linkage (lever) 39 between itself and the door 31. With the presence of this linkage, as the door 31 is moved from its open position B to its closed position A, the rod 40 is moved rearward from its frontmost position E (FIGS. 5 and 11) to its rearmost position F (FIGS. 5 and 11) by the movement of the door 31.

There are disposed cam grooves 41 (41Y, 41M, 41C and 41K), which correspond one for one to the spring cartridge holders 42, in such a manner that their lengthwise directions are parallel to the lengthwise direction of the rod 40, and also, that roller (cam follower) 42*b*, with which the arm 42*a* of each spring cartridge holder 42 is provided, fits in the corresponding cam groove 41.

With the employment of the above described structural arrangement, the spring cartridge holder 42 is moved into the pressure application position C (FIGS. 9 and 11) where it applies pressure to the cartridge P, by the closing movement of the door 31, or its inaction position D where it does not apply pressure to the cartridge P, by the opening movement of the door 31. That is, as the door 31 is moved from its closed position A to its open position B, the spring cartridge holder 42 is moved from its pressure application position C to its no-pressure position D, by the movement of the door 31. Further, as the door 31 is moved from its open position B to its closed position A, the spring cartridge holder 42 is moved from its no-pressure position D to its pressure application position C, by the movement of the door 31.

As the door 31 is closed, the rod 40 is moved in the frontward direction E by the linkage 39. Thus, each spring cartridge holder 42 is pivotally driven by the combination of the cam groove 41 and roller 42*b*, in the direction to move from the no pressure application position D to the pressure application position C, coming into contact with the top surface of the cartridge P and applying therefore the preset amount of pressure to the cartridge P. Thus, the cartridge P is pressed upon the cartridge positioning plate 45, being thereby properly positioned relative to the tray 35 (apparatus main assembly 101) (FIGS. 9 and 11).

On the other hand, as the door 31 is opened, the rod 40 is moved in the rearward direction F by the linkage 39 which is between the door 31 and rod 40. Thus, the each spring cartridge holder 42 is pivotally driven by the combination of the cam groove 41 and roller 42*b*, in the direction to move from the pressure application position C to the no pressure application position D, moving away (separating) from the top surface of the cartridge P (FIGS. 8 and 10), allowing thereby the tray 31 and cartridges P therein to move upward (FIG. 8). Thereafter, the tray 35 can be pulled out of the apparatus main assembly 101 to replace the cartridges P, as described above.

In the description of the structure of the cartridge pressing means given above, the linkage 39, rod 40, cam groove 41, and roller 42*b*, make up the component which causes the spring cartridge holder 42 to be moved into its pressure application position C or its no pressure application position D, by the closing or opening of the door 31.

(Cartridge Movement Regulating Component)

Referring to FIGS. 10 and 11, there are disposed cartridge pressing components 50 (50Y, 50M, 50C and 50K) as cartridge movement regulating components, in the adjacencies of the cartridge pressing mechanism made up of the spring cartridge holder 42 and its internal spring 43. Each cartridge pressing component 50 is disposed in the adjacencies of the corresponding spring cartridge holder 42, being supported by the guiding component 70 so that it can be pivotally moved relative to the guiding component 70.

Each pressing component 50 is in engagement with the corresponding spring cartridge holder 43 and gears 42*c* and 52. The gear 42*c* is an integral part of the spring cartridge holder 42, and is concentric with the spring cartridge holder 42. The gear 52 is an integral part of the pressing component 50, and is concentric with the pressing component 50.

With the employment of the above-described structural arrangement, as the door 31 is opened or closed, the spring cartridge holder 42 is pivotally moved by the movement of the door 31, and therefore, each pressing component 50 is rotated by the pivotal movement of the corresponding spring cartridge holder 42. Therefore, the cartridge pressing portion 51, which is an integral part of the pressing component 50 as the cartridge regulating component, is pivotally moved about the axial line of the pressing component 50. That is, as the door 31 is opened, this cartridge pressing portion 51 is moved into its non-regulation position (FIGS. 8 and 10) in which it is away from the top surface of the cartridge P, whereas as the door 31 is closed, the cartridge pressing portion 51 is moved into its regulating position (FIGS. 9, 11 and 12) in which it presses on the top surface of the cartridge P; the cartridge pressing portion 51 is moved between the no-regulation position and regulating position.

That is, as the door 31 is moved from its open position B to its closed position A, the pressing component 50 regulates the cartridge P in movement, by being moved by the movement of the door 31 into the proximity position G in which it is near the cartridge P which is in its image formation position. When the regulating portion 51 is opposing the cartridge P with the presence of a gap between the regulating portion 51 and cartridge P, the distance between the regulating portion 51 and cartridge P is desired to be large enough to prevent the regulating portion 51 from interfering with the cartridge P, but to be no more than 1 mm.

Further, as the door 31 is moved from its closed position A to its open position B, the pressing component 50 is moved by the movement of the door 31 into the separation position H in which it remains separated from the cartridge P, allowing thereby the cartridge P to be moved from the image formation position to the non-contact position. Further, the pressing component 50 retracts from the passage through which the cartridges P are moved into, or out of, the apparatus main assembly 101 through the opening 30.

In this embodiment, the pressing component 50 moves from its proximity position G to its separation position H by being rotationally moved by the movement of the door 31 from the closed position A to the open position B. Further, it moves from its separation position H to its proximity position G by being rotationally moved by the movement of the door 31 from the open position B to the closed position A. The pressing component 50 is moved by the movement of the door 31 from the closed position A to the opening position B, and the movement of the door 31 from the open position B to the closed position B, with the presence of the spring cartridge holder 42 between the pressing component 50 and door 31.

By the way, as described in the section related to "Problems to Be Solved by Present Invention", the spring 43 prevents the cartridge P from separating from the cartridge positioning plate 45, by the reaction force and the like generated therein by the driving of the drum 1 during an image forming operation. Therefore, the spring 43 is structured so that it is provided with resiliency necessary to keep the cartridge P in the normal position.

However, the spring 43 is not to be allowed to be given resiliency strong enough to prevent the cartridge P from being shifted by the vibrations which occur as the image forming apparatus 100 in which the cartridges P are present is transported, and/or impacts which occur as the apparatus is accidentally dropped during the transportation of the apparatus.

If the pressing component 50 is given resiliency strong enough to prevent the above described problem, the amount of force necessary to open or close the door 31 will be very large, which in turn requires a user to exert a large amount of force to open or close the door 31, and/or the lever 37, rod 40, linkage 39, etc., may be damaged.

That is, it is rather difficult to prevent the cartridges P in the image forming apparatus 100 from shifting during the transportation of the apparatus 100, with the use of only the resiliency of the spring 43. Therefore, it is possible that during the transportation of the image forming apparatus 100, the cartridges P in the apparatus main assembly 101 will dislodge from their normal positions; the springs 43 will be deformed by the excessive amount of load to which they are subjected; and/or the spring cartridge holder 42, rod 40, etc., will be damaged.

An example of the conventional art for solving the above described problems was to place spacers or the like dedicated to the transportation of an image forming apparatus, in the adjacencies of the cartridges P, in order to prevent the cartridges P from shifting, by minimizing the gaps which are present between the cartridges P and the adjacent components. However, these spacers or the like have to be removed by a user before the image forming apparatus 100 is put to use for the first time, reducing thereby the image forming apparatus 100 in usability.

Providing the image forming apparatus with the pressing components 50 as in this embodiment makes it possible to reduce to a very small amount, the distance by which the cartridges P in the image formation positions of the image forming apparatus 100 are made to shift by the impacts which occur during the transportation of the image forming apparatus 100. Therefore, it can regulate the movement of the cartridges P in the image forming apparatus 100, without relying on the resiliency of the springs 43.

Further, when the pressing components 50 are rotationally moved by the opening and closing movement of the door 31, the pressing components 50 do not come into contact with the cartridges P, etc. Thus, the pressing components 50 are not subjected to the reaction force generated in the springs, etc. Therefore, the effect of the pressing components 50 upon the amount of the force necessary to open or close the door 31 is negligible.

Further, as the door 31 is opened, the pressing components 50 are made to separate from the cartridges P. Therefore, they do not interfere with the operation for installing or removing the cartridges P. In other words, they have no effect upon the usability.

Figure 12:
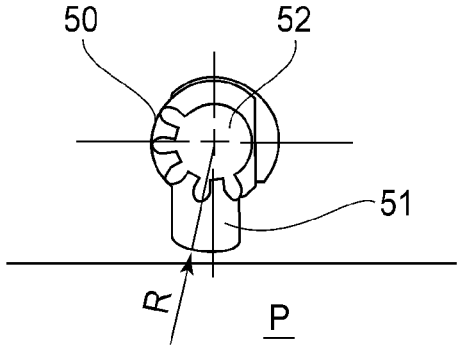
FIG. 12 is a drawing of the cartridge pressing component (cartridge movement regulating component). It shows the shape of the cartridge pressing end portion of the component.

Further, referring to FIG. 12, in terms of the cross sectional view perpendicular to the rotational axis of the pressing portion 51, the pressing portion 51 is arced in such a manner that its curvature is concentric with the rotational axis of the rotational movement of the pressing component 50. Therefore, even if the cartridges P come into contact with the pressing components 50, such force that works in the direction to rotate the pressing component 50 is not generated. Therefore, there is virtually no possibility that the pressing components 50 are robbed of their function of preventing the cartridges P from shifting, by being rotated by their contact with the process cartridges P. Therefore, the image forming apparatus 100 is reliable in terms of the prevention of the shifting of the process cartridges P in the apparatus main assembly 101 during the transportation of the image forming apparatus 100. Here, regarding the material for the pressing components 50, in order to ensure that the pressing components 50 prevent the shifting of the cartridges P, the pressing components 50 are formed of a resinous substance, such as ABS, the elastic modulus of which is greater than the elastic modulus of the springs 43.

As described above, with the employment of the pressing components 50 structured as described above, it is possible to provide an image forming apparatus which can prevent the cartridges in the image forming apparatus, and/or main assembly of the image forming apparatus, from being damaged during the transportation the image forming apparatus, and which is no less in usability than any image forming apparatus in accordance with the prior art.

Embodiment 2

Figure 13:
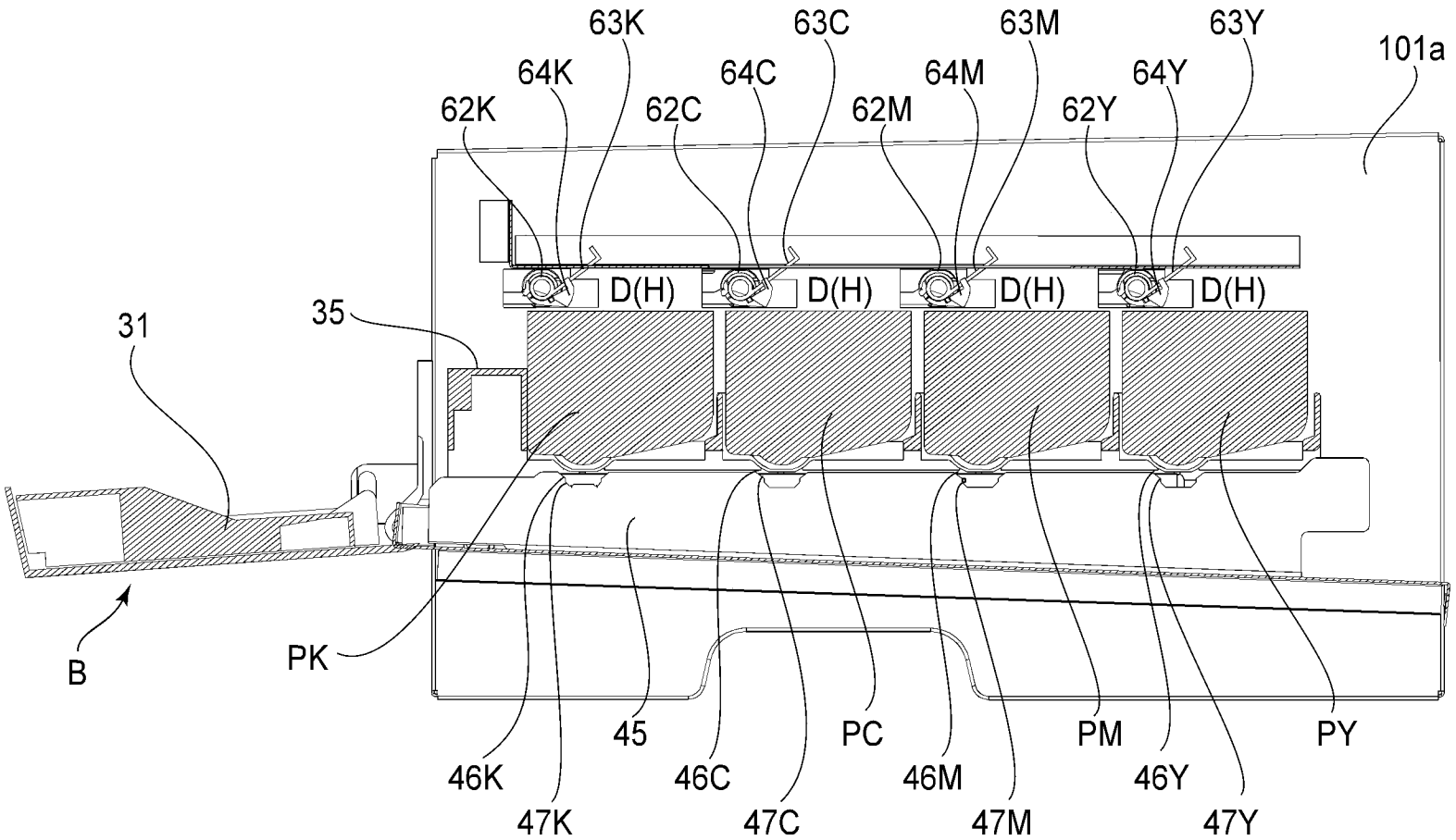
FIG. 13 is a sectional view of the cartridge pressing mechanism of the image forming apparatus in the second embodiment when the door of the apparatus is open.
Figure 14:
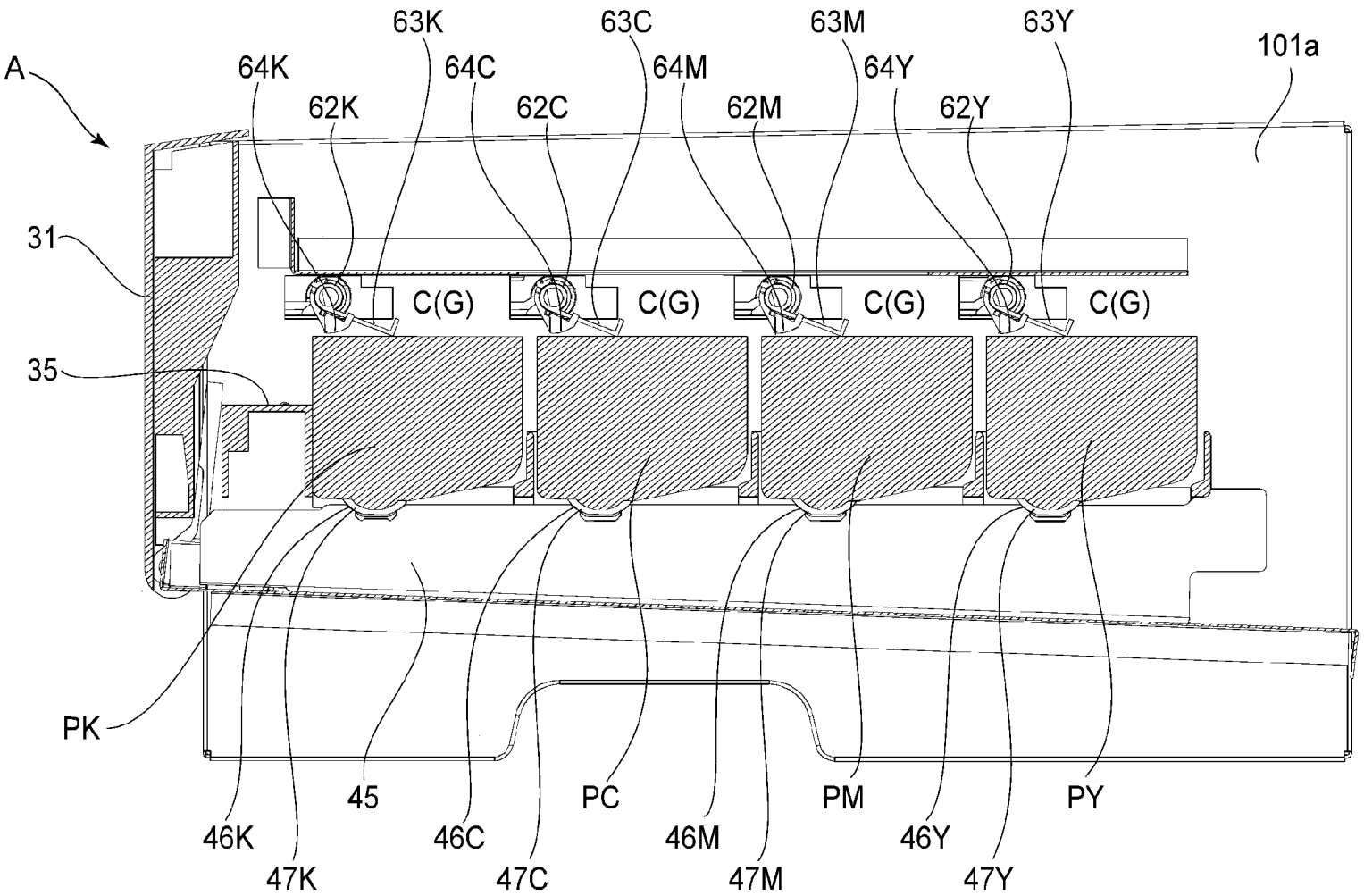
FIG. 14 is a sectional view of the cartridge pressing mechanism of the image forming apparatus in the second embodiment when the door of the apparatus is closed.

One of the characteristic features of the image forming apparatus in the second embodiment of the present invention is that the cartridge movement regulating component is an integral part of the elastic pressing component. The general structure of the image forming apparatus 100 in the second embodiment is the same as that of the image forming apparatus 100 in the first embodiment. Further, the structural arrangement, in this embodiment, for pressing the cartridges P is roughly the same as that in the first embodiment, as shown in FIGS. 13 and 14 (sectional views of image forming apparatus when door 31 is open and closed, respective), and FIGS. 15 and 16 (sectional views of pressing component and its adjacencies when the door 31 is open and closed, respectively).

The spring cartridge holder 62 in this embodiment corresponds to the spring cartridge holder 42 in the first embodiment. The cartridge pressing portion 64, with which the spring cartridge holder 62 is provided, is an integral part of the spring cartridge holder 62, and is shaped so that its cartridge contacting surface is arced so that the center of its curvature coincides with the rotational axis of the spring cartridge holder 62. The image forming apparatus 100 is structured so that the cartridge pressing portion 64 is in the adjacencies of the corresponding cartridge P.

With the image forming apparatus 100 being structured as described above, it is possible to enable the spring cartridge holder 62 to have the above described function of the pressing component 50, making it possible to eliminate the pressing component 50, which in turn makes it possible to reduce an image forming apparatus in component count and cost. Further, like in the first embodiment, the pivotal axis of the cartridge pressing portion 64 of the spring cartridge holder 62 coincides with the pivotal axis of the spring cartridge holder 64. Therefore, even if the cartridge P comes into contact with the cartridge pressing portion 64, the contact does not generate rotational force. Therefore, it is unlikely for the spring cartridge holder 62 to lose its function of regulating the movement of the cartridge P. Therefore, the image forming apparatus in this embodiment is higher in reliability than the one in the first embodiment.

As described above, by employing the structural arrangement in this embodiment, it is possible to prevent the problem that when an image forming apparatus in which cartridges are positioned in the image formation positions is transported, the cartridges in the image forming apparatus and/or the apparatus main assembly 101 is damaged, without reducing the image forming apparatus in usability, as in the case of the first embodiment. Therefore, it becomes possible to provide an image forming apparatus which is low in cost.

In the first embodiment, however, the pressing component 50 is made to be greater in resiliency, by the setting of the gear ratio between the gears 42*c* and 52, which connect between the door 31 and pressing component 50, than the spring cartridge holder 42, in the angle by which they are rotated by the opening and closing movement of the door 31. This structural arrangement sets the distance by which the cartridge pressing portion 51 of the pressing component 50 is separated from the cartridge P. In comparison, in the second embodiment, the distance by which the cartridge pressing portion 64 is separated from the cartridge P has to be set by increasing the angle by which the spring cartridge holder 62 itself is pivotally moved.

Figure 15:
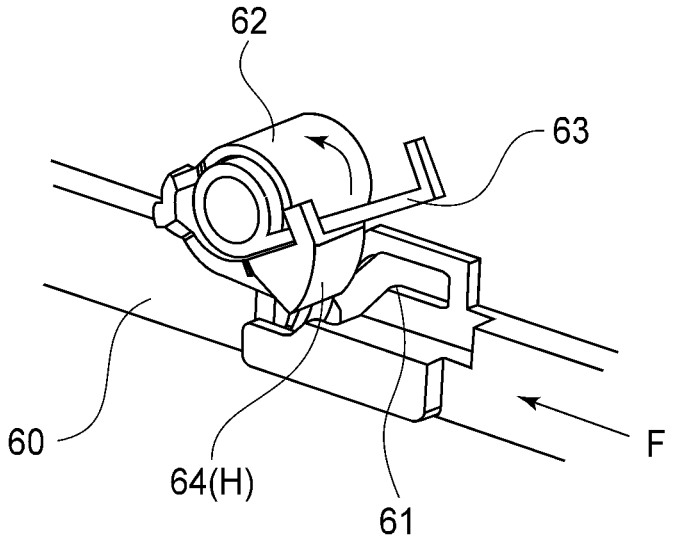
FIG. 15 is a perspective view of the cartridge pressing mechanism and its peripheries when the door is open.
Figure 15:
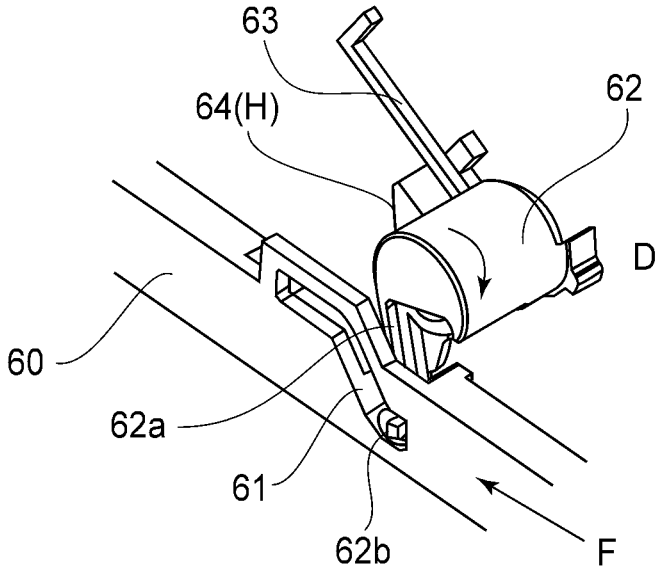
Figure 16:
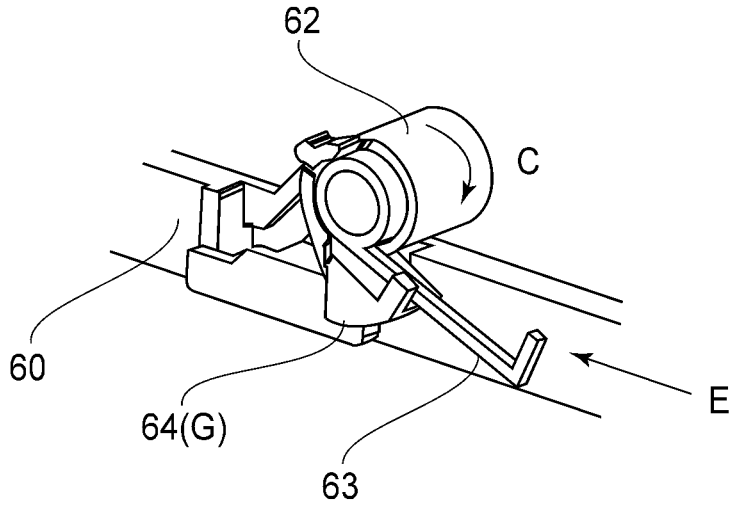
FIG. 16 is a perspective view of the cartridge pressing mechanism and its peripheries when the door is closed.
Figure 16:
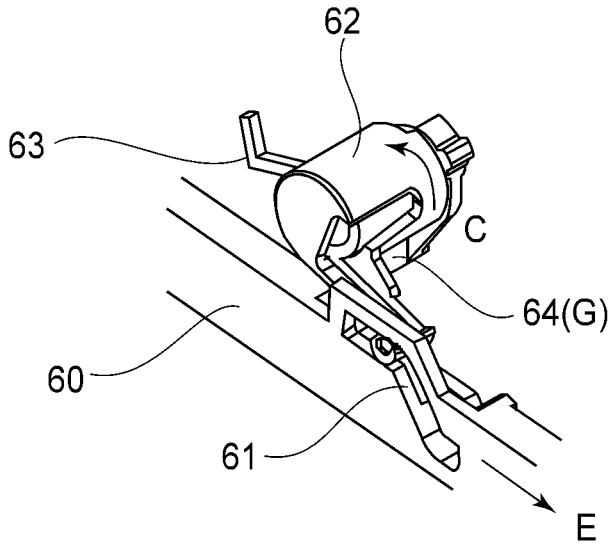

Therefore, the groove 61 with which the rod 60 is provided has to be increased in depth as shown in FIGS. 15 and 16 (when door 31 is opened and closed, respectively), or the like measure has to be taken, in order to increase the angle (amount) by which the spring cartridge holder 62 (and spring 63) is rotated. The amount of force necessary to open or close the door 31 is greater than in the first embodiment, and also, the space necessary, in this embodiment, for the spring cartridge holder 62 itself, and the space for the movement of the spring cartridge holder 63, is greater than those in the first embodiment. Therefore, in some cases, it is difficult to secure the necessary space, in the apparatus main assembly 101.

For the reason given above, the second embodiment is not intended to replace the structural arrangement in the first embodiment, which employs the pressing component 50. The structural arrangement in the second embodiment should be employed in consideration of the size of an image forming apparatus.

Embodiment 3

Next, referring to FIGS. 17-21, the structure of the cartridge pressing means in the third embodiment of the present invention is described. Incidentally, the third to fourth embodiments of the present invention will be described with regard to the structure of the portions of the image forming apparatuses, which are different from the counterparts in the first embodiment.

Figure 17:
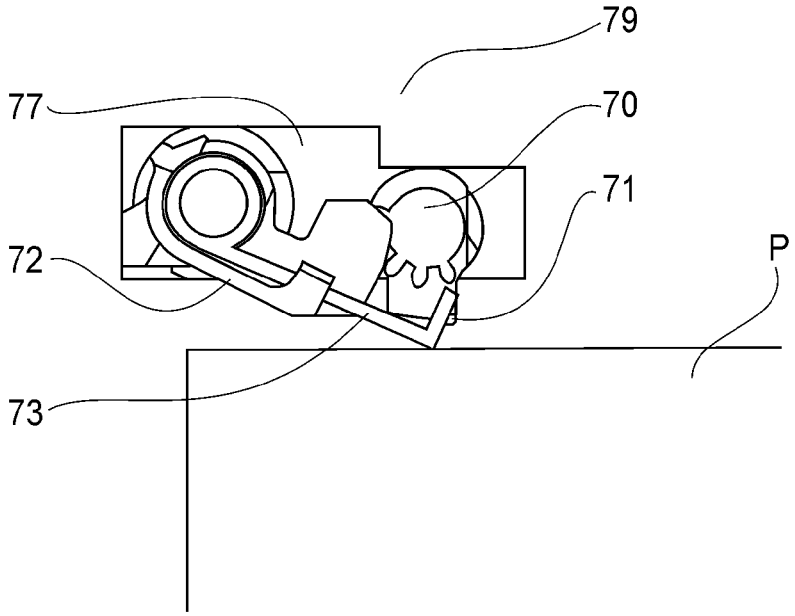
FIG. 17 is a sectional view of the cartridge pressing mechanism and its peripheries in the third embodiment, when the door is closed.
Figure 18:
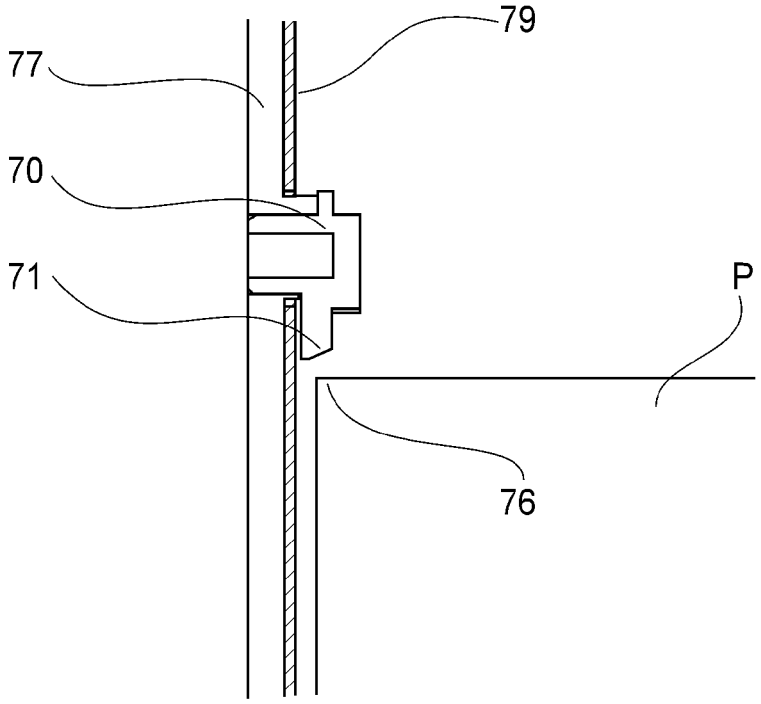
FIG. 18 is a sectional view of the cartridge pressing mechanism and its peripheries in the third embodiment, when the door is closed.
Figure 19:
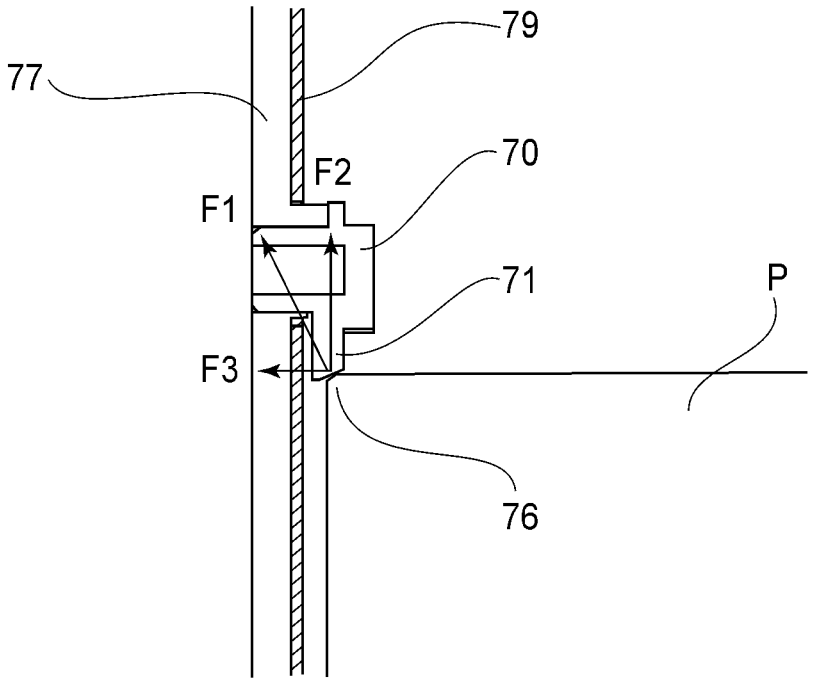
FIG. 19 is a sectional view of the cartridge pressing mechanism and its peripheries in the third embodiment, when the door is closed.

FIG. 17 is a schematic sectional view of the combination of the cartridge pressing mechanism 79, which includes a cartridge pressing component 70, and the cartridge P, at a vertical plane parallel to the moving direction of the tray 35 (FIGS. 3 and 4). FIG. 18 is a schematic sectional view of the combination of the cartridge P and cartridge pressing component 70 when the door 31 is closed. It shows the relationship between the pressing component 70 and cartridge P, when the door 31 is closed. FIG. 19 is a schematic sectional view of the combination of the pressing component 70 and cartridge P after the cartridge P has just been shifted by the impacts and/or the like which occurred during the transportation of the image forming apparatus. It shows the relationship between the pressing component 70 and cartridge P, as seen from the direction parallel to the moving direction of the tray 35.

Also in this embodiment, the pressing component 70 is rotationally moved by the rotational movement of the corresponding spring cartridge holder 72, which is caused by the opening or closing of the door 31, as in the first embodiment. Thus, the cartridge pressing portion 71 (opposing portion) which is an integral part of the pressing component 70 which is a regulating component is rotationally moved. Consequently, as the door 31 is opened, the pressing portion 71 is moved into the no-regulation position (unshown) in which it remains separated from the top surface of the cartridge P, whereas as the door 31 is closed, the pressing portion 71 is moved into the regulation position (FIG. 18) in which it presses on the top surface of the cartridge P, as shown in FIGS. 17 and 18. Further, referring to FIG. 18, the pressing component 70 is rotatably supported by the supporting portion 77, with which the lateral plate 79 of the apparatus main assembly 101 is provided. The pressing portion 71 of the pressing component 70 is tilted relative to the lengthwise direction of the cartridge P. Further, referring to FIG. 19, as the cartridge P shifts due to the impacts and the like during the transportation of the image forming apparatus, the positioning portion of the cartridge P comes into contact with the pressing portion 71, whereby the pressing portion 71 is subjected to a reaction force F1, indicated by an arrow mark, which is made up of a component F2 which acts upward, and a component F3 which acts in the direction parallel to the lengthwise direction of the cartridge P. That is, the component F3 is generated in the direction to prevent the pressing component 70 from disengaging from the supporting portion 77. Therefore, the pressing component 70 is enabled to regulate the movement of the cartridge P without disengaging from the supporting portion 77.

Figure 20:
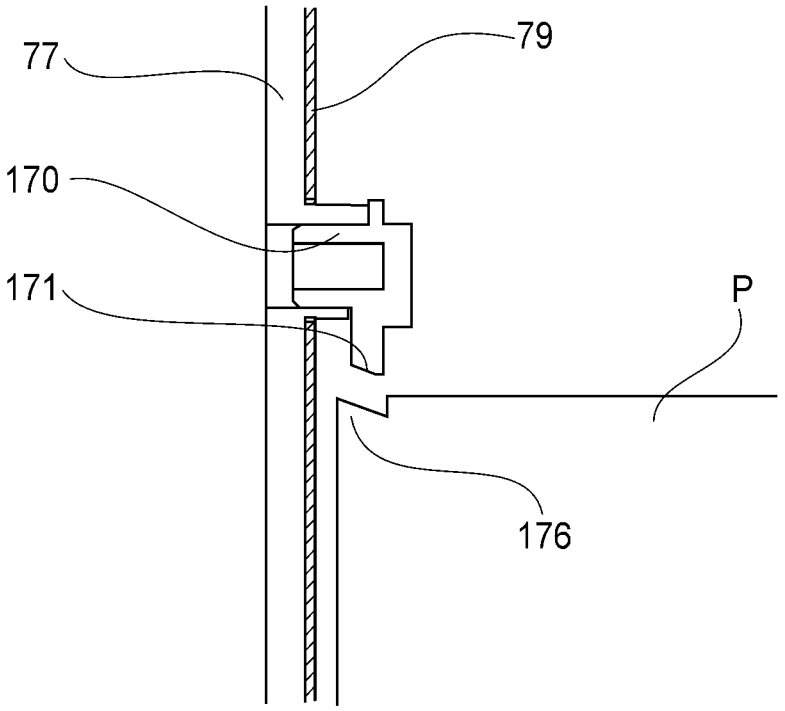
FIG. 20 is a sectional view of the peripheral portions of the cartridge pressing mechanism in the third embodiment, when the door is closed.
Figure 21:
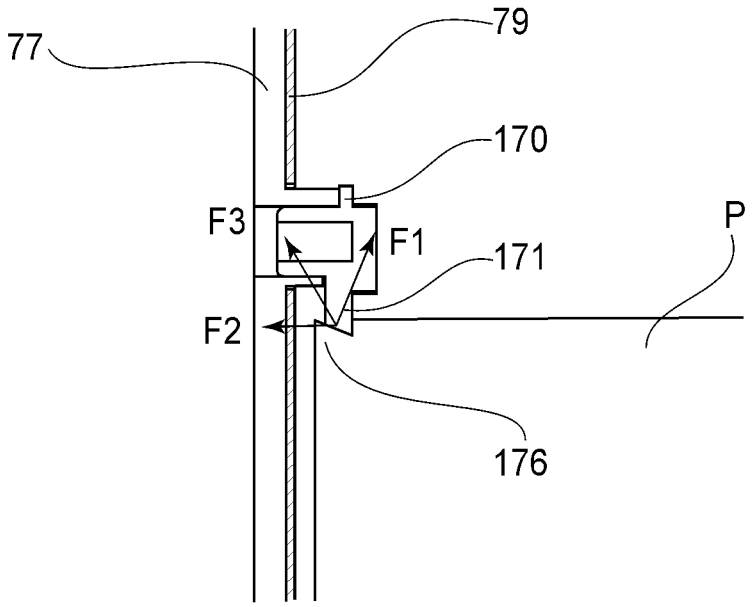
FIG. 21 is a sectional view of the cartridge pressing mechanism and its peripheries in the third embodiment, when the door is closed.

In the third embodiment, the regulating surface of the regulating portion 71 is tilted as shown in FIG. 18. However, such a structural arrangement may be made that the regulating surface of the regulating portion 71 is tilted in the opposite direction from the direction in which it is tilted in FIG. 18, and the portion 176 of contact of the cartridge P is recessed, as shown in FIGS. 20 and 21. The effects of such an arrangement are the same as the effects of the third embodiment. Also in the case of this arrangement, the resultant force F3 from forces F1 and F2 prevents the pressing component 170 from disengaging from the supporting portion 77. Therefore, it is ensured that the cartridge P is prevented from shifting.

Embodiment 4

Figure 22:
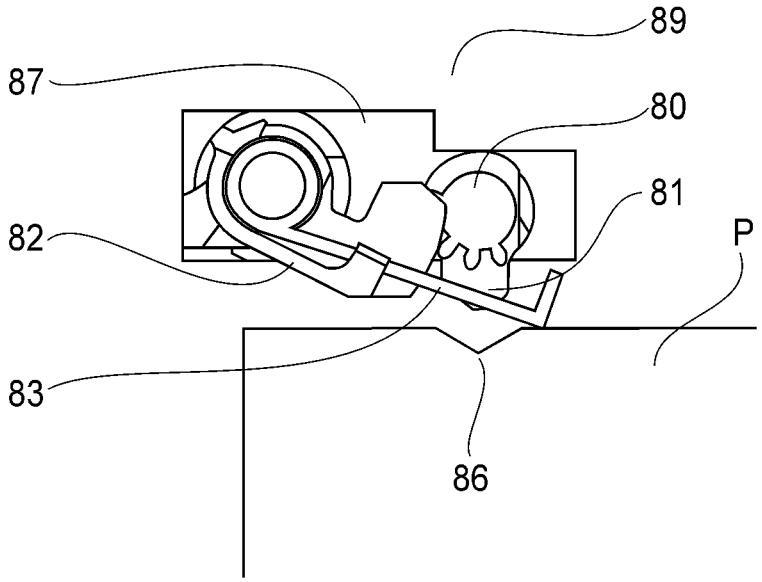
FIG. 22 is a sectional view of the cartridge pressing mechanism and its peripheries in the fourth embodiment, when the door is closed.
Figure 23:
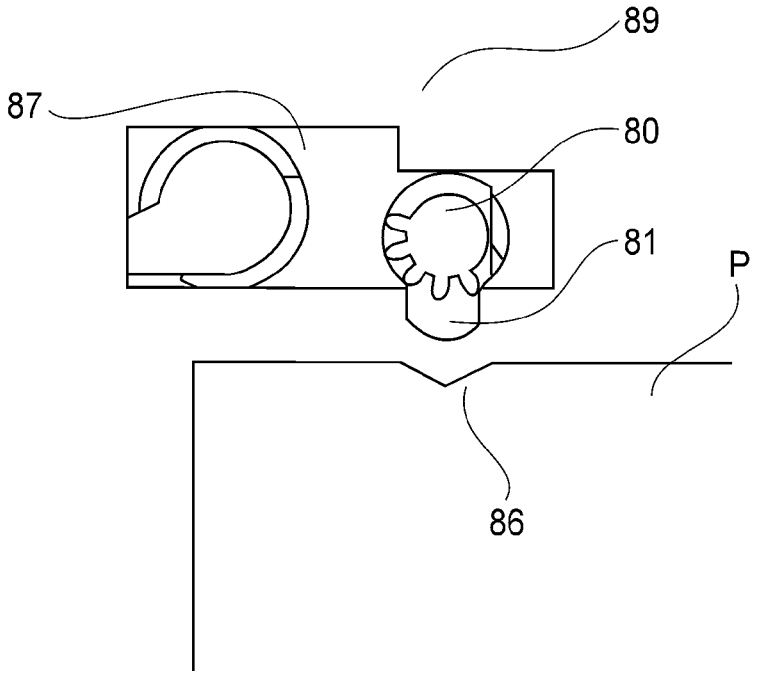
FIG. 23 is a sectional view of the cartridge pressing mechanism and its peripheries in the fourth embodiment, when the door is closed.
Figure 24:
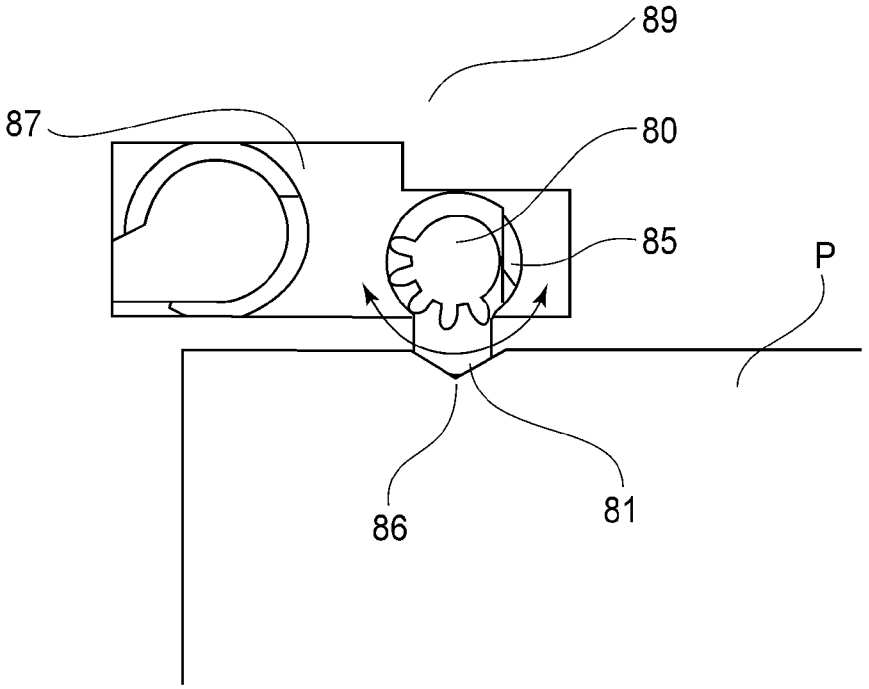
FIG. 24 is a sectional view of the cartridge pressing mechanism and its peripheries in the fourth embodiment, when the door is closed.

Next, referring to FIGS. 22-24, the structure of the cartridge pressing mechanism in the fourth embodiment is described.

FIG. 22 is a schematic sectional view of the cartridge pressing mechanism 89 which includes a pressing component 80, and the cartridge P, at a plane parallel to the moving direction of the tray 35 (FIGS. 3 and 4). It shows the relationship between the mechanism 89 and cartridge P. FIG. 23 is the same as FIG. 22, except that FIG. 23 does not show the spring cartridge holder 83 and spring 80 as a pressing component, for convenience. FIG. 24 is the same as FIG. 23, except that FIG. 24 shows the relationship between the pressing component 80 and cartridge P after the cartridge P was moved by the impact and/or the like which occurred while the image forming apparatus 100 was transported with its door 31 closed.

Referring to FIG. 24, in the case of the cartridge pressing mechanism in this embodiment, even if the portion 86 of contact of the cartridge P is made to contact the cartridge pressing portion 81 of the cartridge pressing component 80, by the above described impact and/or the like, and therefore, the pressing portion 81 is subjected to rotational force which acts on the pressing portion 81 in the direction indicated by a two-headed arrow mark, the portion 86 of contact of the cartridge P, which is in the form of a recess, can prevent the pressing portion 80 from rotationally moving. Thus, it is ensured that the pressing portion 81 perfectly engages with the portion 86 of contact of the cartridge P. Therefore, it is possible to prevent the cartridge P from being shifted by the impacts and/or the like.

In the fourth embodiment, the pressing portion 81 is in the form of a protrusion, whereas the portion 86 of contact of the cartridge P is in the form of a recess. However, the relationship in terms of shape between the pressing portion 81 and portion 86 of contact of the cartridge P may be opposite from the one in this embodiment. That is, the pressing portion 81 may be in the form of a recess, whereas the portion 86 of contact of the cartridge P is in the form of a protrusion. In other words, all that is necessary is that one of the pressing portion 81 and the portion 86 of contact of the cartridge P is in the form of a protrusion, and the other is in the form of a recess. The effects of such a structural arrangement are the same of those in this embodiment.

Figure 25:
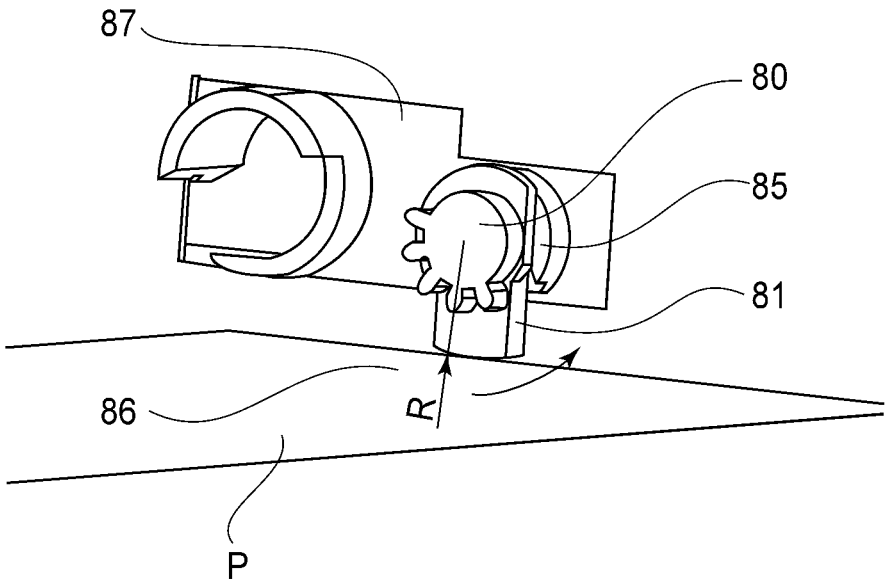
FIG. 25 is a perspective view of the cartridge pressing mechanism and its peripheries in the fourth embodiment, when the door is closed.
Figure 26:
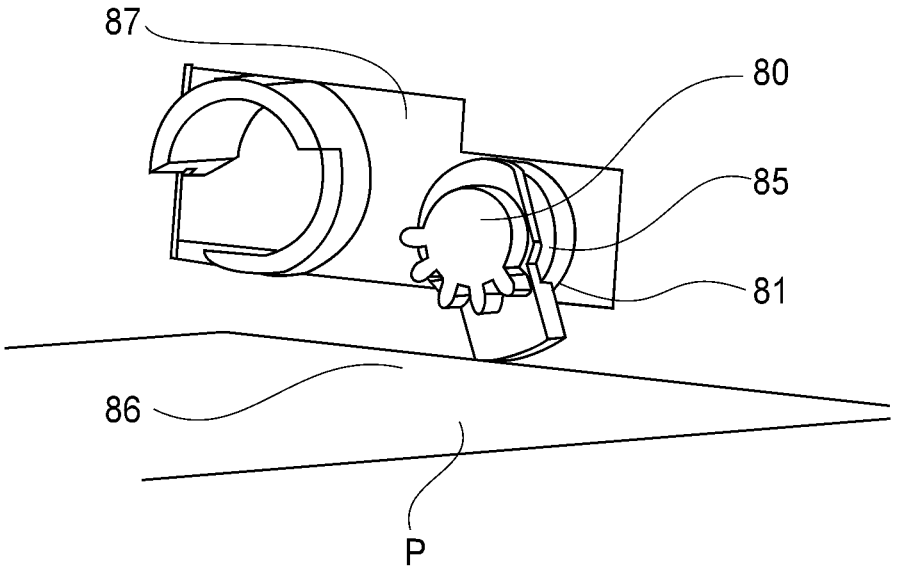
FIG. 26 is a perspective view of the cartridge pressing mechanism and its peripheries in the fourth embodiment, when the door is closed.

Further, in the fourth embodiment, the portion 86 of contact of the cartridge P was used to prevent the pressing portion 81 from being rotationally moved by the aforementioned impacts and/or the like. Instead, however, in order to prevent a cartridge pressing component 80 having a cartridge pressing portion 81 which is arced in cross section, from being rotationally moved in the direction indicated by an arrow mark, a supporting portion 87 may be provided with a stopper 85, as shown in FIGS. 25 and 26. With the provision of the stopper 85, it is ensured that the arc-shaped pressing portion 81 comes into contact with the portion 86 of contact of the cartridge P. It is assumed here that the phase of the stopper 85 is such that the pressing portion 81 comes into contact with the portion 86 of contact of the cartridge P, in spite of the effect of the overall error in dimension of the components of the cartridge pressing mechanism and process cartridge P. Therefore, it is ensured that the pressing portion 81 engages with the portion 86 of contact of the process cartridge P. Therefore, it is possible to regulate the movement of the cartridge P attributable to the impacts and/or the like.

Embodiment 5

Next, referring to FIGS. 27-31, the structure of the cartridge pressing mechanism in the fifth embodiment of the present invention is described.

Figure 27:
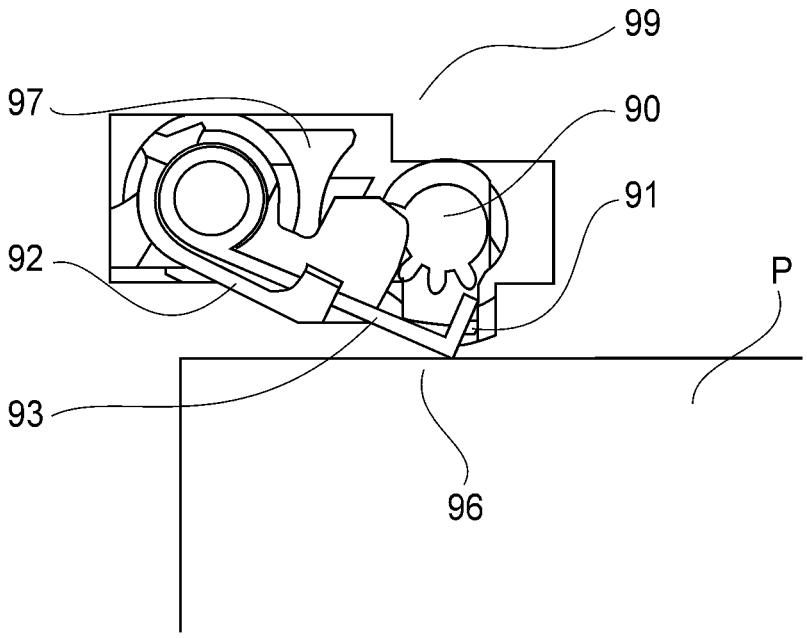
FIG. 27 is a sectional view of the cartridge pressing mechanism and its peripheries in the fifth embodiment, when the door is closed.
Figure 28:
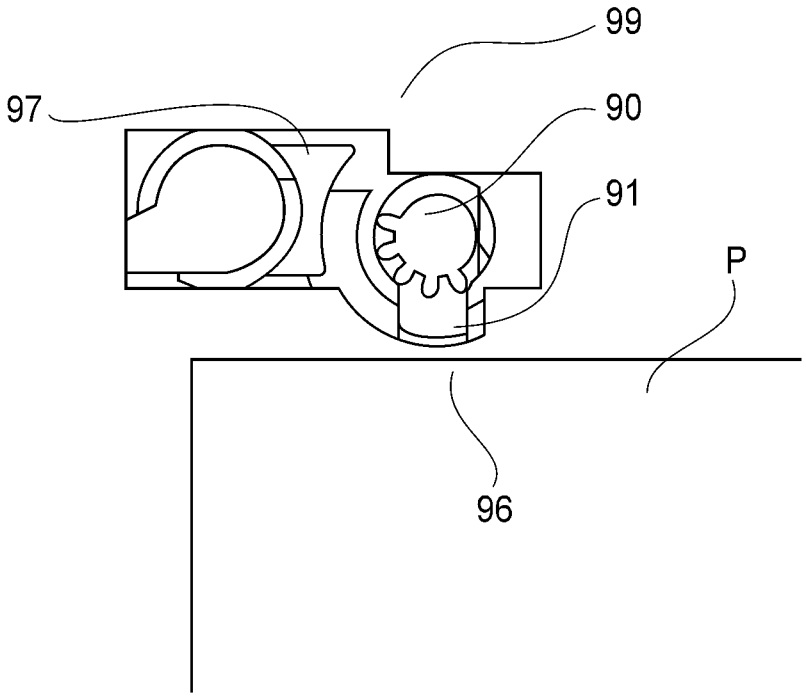
FIG. 28 is a sectional view of the cartridge pressing mechanism and its peripheries in the fifth embodiment, when the door is closed.
Figure 29:
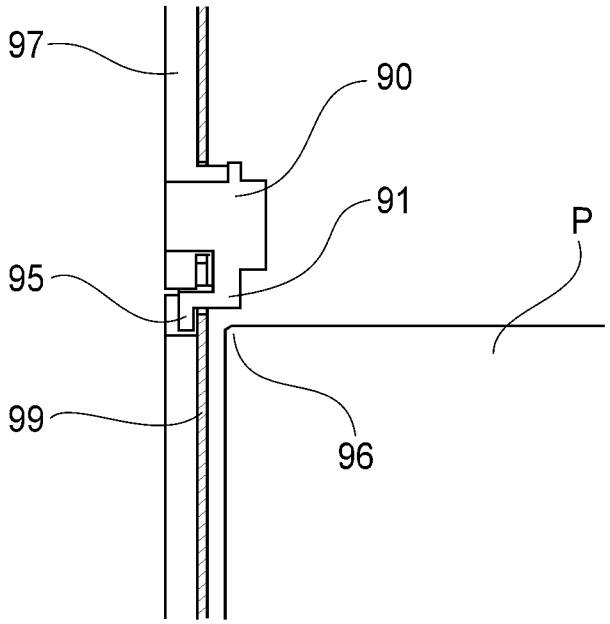
FIG. 29 is a sectional view of the cartridge pressing mechanism and its peripheries in the fifth embodiment, when the door is closed.
Figure 30:
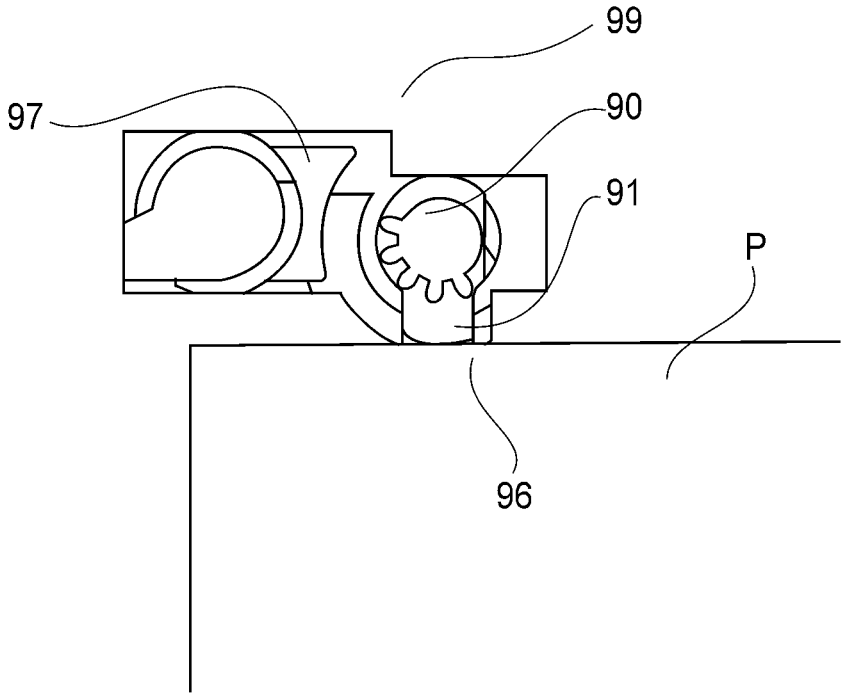
FIG. 30 is a sectional view of the cartridge pressing mechanism and its peripheries in the fifth embodiment, when the door is closed.
Figure 31:
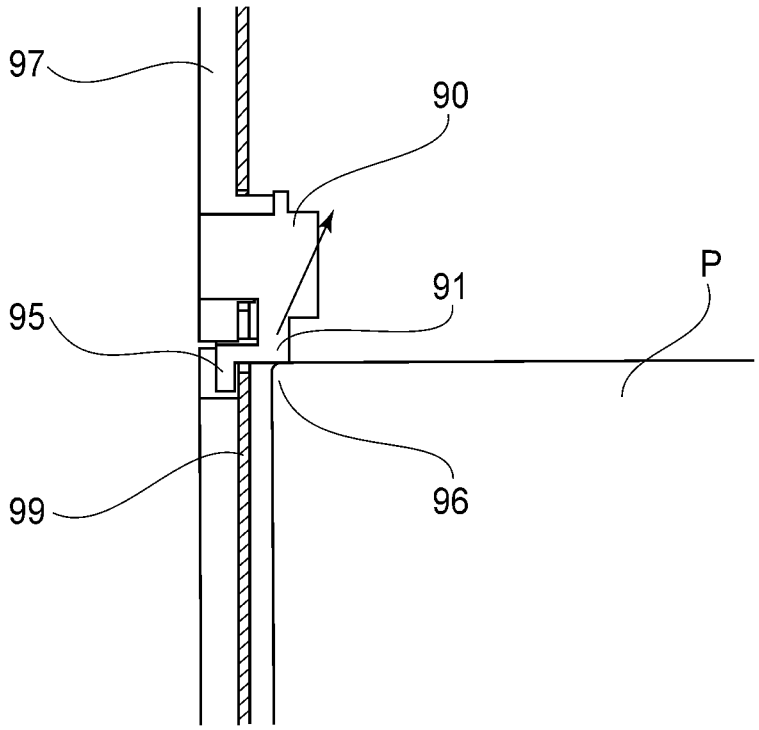
FIG. 31 is a sectional view of the cartridge pressing mechanism and its peripheries in the fifth embodiment, when the door is closed.

FIG. 27 is a schematic sectional view of the cartridge pressing mechanism 99 which includes a cartridge pressing component 90, at a plane parallel to the moving direction of the tray (FIGS. 3 and 4) after the closing of the door (unshown). It shows the relationship between the cartridge pressing mechanism 99 and cartridge P after the closing of the door. FIG. 28 is the same as FIG. 27, except that FIG. 28 does not show the spring cartridge holder 92, and a spring 93 as a cartridge pressing component, for convenience. Further, FIG. 29 is a schematic sectional view of the pressing component 90 and cartridge P, as seen from the direction parallel to the moving direction of the tray, after the closing of the door. It shows the positional relationship between the pressing component 90 and cartridge P after the closing of the door. FIG. 30 is a schematic sectional view of the pressing component 90 and cartridge P at a plane parallel to the moving direction of the tray, after the shifting of the cartridge P caused by the impacts and/or the like which occurred while the image forming apparatus was transported, with its door closed. It shows the positional relationship between the pressing component 90 and cartridge P after the shifting of the cartridge P. FIG. 31 is a schematic sectional view of the pressing component 90 and cartridge P, at a plane perpendicular to the moving direction of the tray, after the cartridge P was shifted by the impacts and/or the like which occurred while the image forming apparatus was transported, with its door closed.

Referring to FIG. 29, in terms of the lengthwise direction of the cartridge P, the cartridge engaging portion 95 of the pressing component 90 is disposed on the opposite side of the lateral plate 99 from the pressing portion 91. Referring to FIG. 31, as the cartridge P is shifted due to the impacts and/or the like which occur during the transportation of the image forming apparatus, the portion 96 of contact of the cartridge P comes into contact with the pressing portion 91. Therefore, even if the pressing component 90 is subjected to such force that acts in the direction indicated by an arrow mark, the engaging portion 95 of the pressing component 90 comes into contact with the lateral plate 99, being enabled thereby to prevent the cartridge P from moving farther in the direction indicated by the arrow mark. That is, the pressing portion 90 can be prevented from becoming disengaged from the supporting portion 97. Therefore, it is possible to regulate, with certainty, the movement of the cartridge P, which is caused by the impacts and/or the like.

(Miscellanies)

1) In the embodiments of the present invention described above, the cartridge P which is removably installable in the apparatus main assembly 101 is a process cartridge of the integration type. However, these embodiments are not intended to limit the present invention in scope in terms of cartridge type. That is, the present invention is also applicable to a process cartridge of the separation type and a development cartridge.

2) The number of cartridges P installable for an image forming operation does not need to be limited to four. It should be set as necessary. For example, in the case of an image forming apparatus for forming a monochromatic image, the number of process cartridge or development cartridge to be installed for an image formation is one.

According to the present invention, the problem that when an image forming apparatus in which cartridges are present in their image formation positions is transported, the cartridges shift, can be prevented without reducing the image forming apparatus in usability. Thus, it is possible to protect the cartridges and image forming apparatus during the transportation of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 195024/2012 and 163751/2013 filed Sep. 5, 2012 and Aug. 7, 2013, respectively, which are hereby incorporated by reference.

What is claimed is:

1. An image forming apparatus for forming an image on a recording material, wherein a cartridge is detachably mountable, said image forming apparatus comprising:

an opening through which said cartridge is passed when said cartridge is mounted to and demounted from a main assembly of said apparatus;

an openable member movable between a closed position for closing said opening and an open position for opening said opening;

a pressing member movable between a pressing position for applying a pressing force to said cartridge to fix said cartridge to an image forming position inside the main assembly, and a non-pressing position in which said cartridge is not pressed by said pressing member;

an interrelating member for interrelations such that (i) with movement of said openable member from the closed position to the open position, said pressing member moves from the pressing position to the non-pressing position, and said cartridge moves from the image forming position to a retracted position, and (ii) with movement of said openable member from the open position to the closed position, said cartridge moves from the retracted position to the image forming position, and said pressing member moves from the non-pressing position to the pressing position; and a limiting member movable between a limiting position for preventing said cartridge positioned in the image forming position from moving against the pressing force of said pressing member, and a non-limiting position for permitting said cartridge to move from the image forming position to the retracted position, wherein said limiting member is rotated by the movement of said openable member from the closed position to the open position to move from the limiting position to the non-limiting position, and is rotated by the movement of said openable member from the open position to the closed position to move from the non-limiting position to the limiting position.

2. An apparatus according to claim 1, wherein said limiting member is in the limiting position when taking the closed position of said openable member, and is in the non-limiting position when taking the open position of said openable member.

3. An apparatus according to claim 1, wherein said limiting member is in non-contact with said cartridge when taking the limiting position.

4. An apparatus according to claim 1, wherein said limiting member is moved through said pressing member in interrelation with movement of said openable member from the closed position to the open position, and in interrelation with movement of said openable member from the open position to the closed position.

5. An apparatus according to claim 1, wherein said limiting member includes an operating portion for limiting movement by being abutted by said cartridge, and said operating portion receives a force from said cartridge for preventing said limiting member from disengaging from the main assembly.

6. An apparatus according to claim 5, wherein said operating portion has an inclined surface.

7. An apparatus according to claim 5, wherein said operating portion is engaged with an operated portion on said cartridge to receive the force from said cartridge for preventing said limiting member from disengaging from the main assembly.

8. An apparatus according to claim 1, wherein said limiting member includes an operating portion for limiting movement by being abutted by said cartridge, and a limiting portion for preventing said limiting member from disengaging from the main assembly by engagement with the main assembly.

9. An apparatus according to claim 1, wherein said pressing member includes a spring, and said limiting member has a modulus of elasticity higher than that of said spring.

10. An apparatus according to claim 1, wherein said cartridge includes an image bearing member, which contacts with a transfer member provided in the main assembly in the image forming position, and is spaced from the transfer member in the retracted position.

11. An apparatus according to claim 1, further comprising a drawer member movable while supporting said cartridge, wherein said cartridge is mountable and demountable relative to said drawer member when said drawer member takes an outside position, and wherein said cartridge is movable between the image forming position and the retracted position when said drawer member takes an inside position.

12. An apparatus according to claim 11, wherein said drawer member is capable of supporting a plurality of such cartridges.

13. An image forming apparatus for forming an image on a recording material, wherein a cartridge is detachably mountable, said image forming apparatus comprising:

an opening through which said cartridge is passed when said cartridge is mounted to and demounted from a main assembly of said apparatus;

an openable member movable between a closed position for closing said opening and an open position for opening said opening;

a pressing member movable between a pressing position for applying a pressing force to said cartridge to fix said cartridge to an image forming position inside the main assembly, and a non-pressing position in which said cartridge is not pressed by said pressing member;

an interrelating member for interrelations such that (i) with movement of said openable member from the closed position to the open position, said pressing member moves from the pressing position to the non-pressing position, and said cartridge moves from the image forming position to a retracted position, and (ii) with movement of said openable member from the open position to the closed position, said cartridge moves from the retracted position to the image forming position, and said pressing member moves from the non-pressing position to the pressing position; and a limiting member movable between a limiting position for preventing said cartridge positioned in the image forming position from moving against the pressing force of said pressing member, and a non-limiting position, for permitting said cartridge to move from the image forming position to the retracted position, wherein said limiting member is a part of said pressing member.

14. An apparatus according to claim 13, wherein said limiting member is rotated by the movement of said openable member from the closed position to the open position to move from the limiting position to the non-limiting position, and is rotated by the movement of said openable member from the open position to the closed position to move from the non-limiting position to the limiting position.

15. An apparatus according to claim 14, wherein said limiting member includes an operating portion for limiting movement by being abutted by said cartridge, and said operating portion has an arcuate configuration substantially concentric with a rotation axis of said limiting member.

16. An apparatus according to claim 15, wherein said operating portion is engaged with an operated portion provided on said cartridge so that rotation of said limiting member is limited.

17. An apparatus according to claim 16, wherein said operating portion and said operated portion have complementary projecting and recessed configurations.

* * * * *